United States Patent [19]

Sivilotti

[11] 4,061,177

[45] Dec. 6, 1977

[54] APPARATUS AND PROCEDURE FOR THE BELT CASTING OF METAL

[75] Inventor: Olivo Giuseppe Sivilotti, Kingston, Canada

[73] Assignee: Alcan Research and Development Limited, Montreal, Canada

[21] Appl. No.: 568,312

[22] Filed: Apr. 15, 1975

[51] Int. Cl.[2] ..... B22D 11/06; B22D 27/16

[52] U.S. Cl. ..... 164/87; 164/149; 164/253; 164/432; 164/435; 164/436; 164/443

[58] Field of Search ..... 164/87, 149, 253, 278, 164/283 MT

[56] References Cited

U.S. PATENT DOCUMENTS

| | | | |
|---|---|---|---|
| 2,928,148 | 3/1960 | Porterfield | 164/283 MT |
| 3,041,686 | 7/1962 | Hazelett et al. | 164/278 |
| 3,426,836 | 2/1969 | Altenpohl et al. | 164/87 |
| 3,452,809 | 7/1969 | Dumont-Fillon | 164/278 |
| 3,502,135 | 3/1970 | Wertli | 164/253 |
| 3,864,973 | 2/1975 | Petry | 164/278 |
| 3,933,193 | 1/1976 | Baker et al. | 164/278 |

FOREIGN PATENT DOCUMENTS

| | | | |
|---|---|---|---|
| 1,387,992 | 3/1975 | United Kingdom | 164/87 |

*Primary Examiner*—Leonidas Vlachos
*Attorney, Agent, or Firm*—Cooper, Dunham, Clark, Griffin & Moran

[57] ABSTRACT

In apparatus for the continuous casting of metal in strip form between moving belts, belt support means comprising a multiplicity of elements that are distributed crosswise and lengthwise of a belt path area beside the mold space and are individually yieldable against a loading force, permit close belt stabilization to a selected path while yielding locally under excess outward force by the belt such as caused by solidified metal. Arrangement of belt support and cooling means along the mold space in successive sections each individually adjusted in respect to one or more of the conditions of belt path taper; degree of compliance, if any, in the retention of the belt against the support; and cooling action; are such that these features, as well as provision, if desired, of local yieldability, permit accommodation of the apparatus to various requirements of casting operation.

A specific process for casting, well realized with the foregoing apparatus, includes controlling the stabilization of the belt along its path so that in a first zone where the metal is essentially liquid, the belt is held firmly against the supports, while in a second zone the belt may if necessary have soft support in the sense of locally following the surface shell of metal to avoid local impairment of cooling; this method may include provision of highly localized yieldability as by the above means, especially in later zones of the path where the metal completes solidification. Process improvement is further afforded, with a closed path for liquid coolant, by recirculating the liquid while controlling its temperature to a somewhat elevated level and if desired, adjusting its chemical character.

The apparatus also has means for adjusting the contour of the belt support sections transversely of the path, e.g. to afford a profile concave toward the mold space for better assuring a flat product, such means coacting especially with the individually yieldable support elements across and along the path. The belts travel around carriage structures supported in desired relation to each other, with simplified means for separating one carriage from the other, for servicing purposes.

15 Claims, 15 Drawing Figures

Fig. 3.
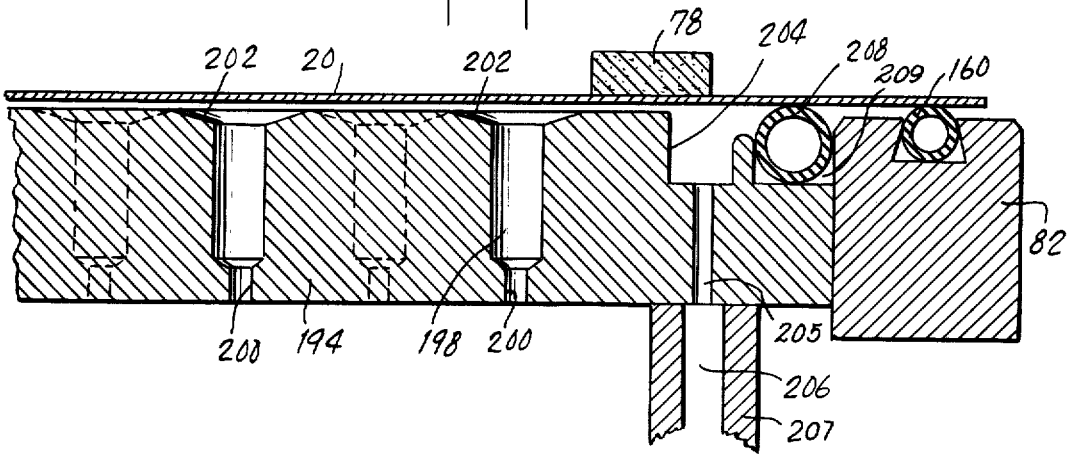
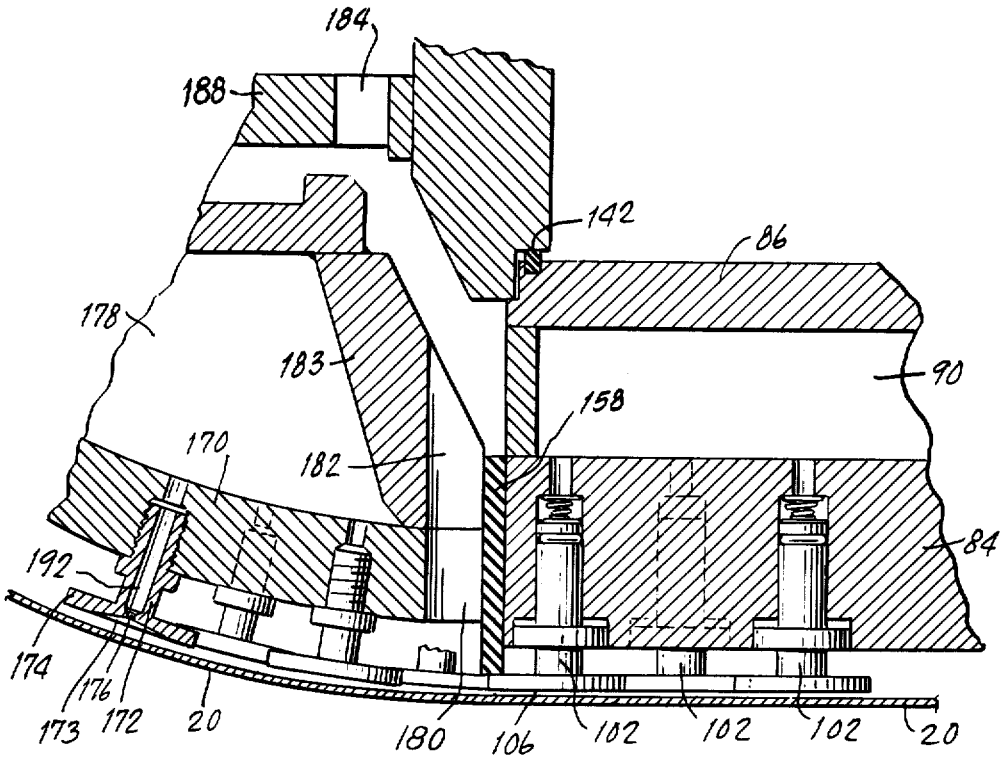
Fig. 4.

Fig. 12.
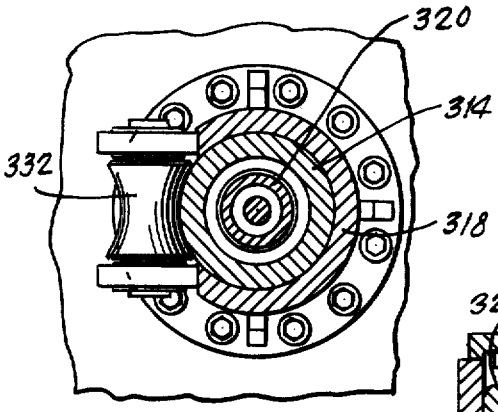
Fig. 13.
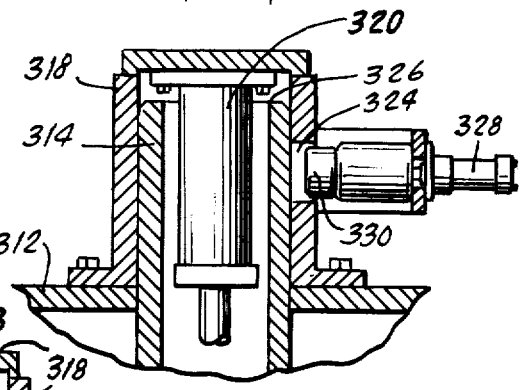
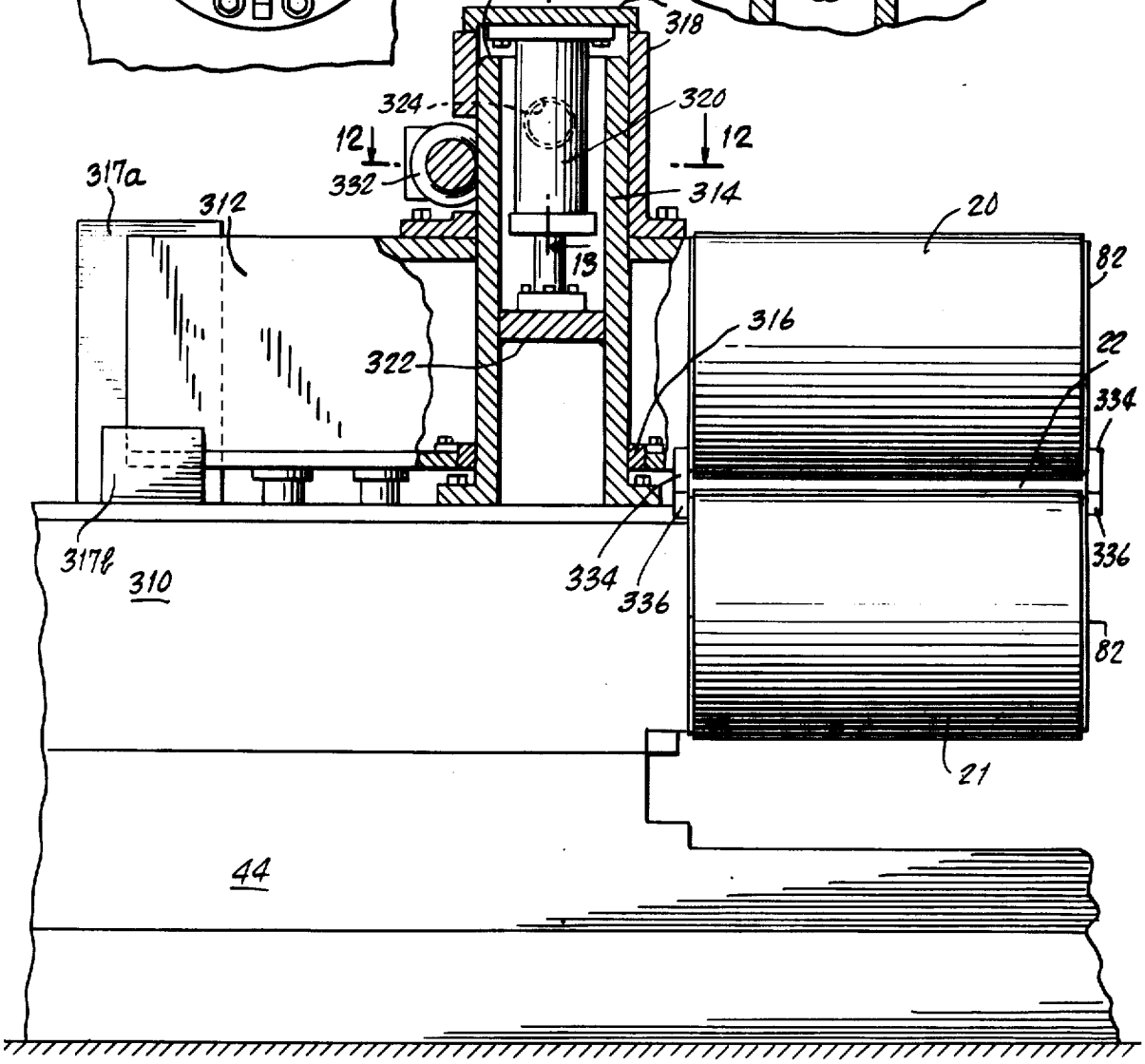
Fig. 11.

APPARATUS AND PROCEDURE FOR THE BELT CASTING OF METAL

BACKGROUND OF THE INVENTION

This invention relates to apparatus and procedure for the belt casting of metal, more specifically the continuous casting of metal between endless belts, in the form of strip. In a notably important sense, the invention is concerned with methods and machines for casting metals such as aluminum (including aluminum alloys) and zinc, and other metals, which melt at moderate or low temperatures, between a pair of moving surfaces conveniently constituted of flexible heat-conducting bands or belts that have conventionally been metal belts in twin-belt casters of this sort.

Although the continuous casting of metal, including especially the casting of aluminum and similar light metals, in belt-casting apparatus has been under development for many years, and although useful improvements in guiding, stabilizing, and cooling the belts of such casters have been made, it does not appear that a number of important problems of control as to a desired intimacy of contact between the belts and the solidifying metal and as to other characteristics of stabilizing and cooling the belt, have been fully recognized or that means for providing such control in an effective manner have been heretofore known or available in prior apparatus.

Extended investigation has revealed that continuing, intimate contact between the belts and the metal, while maintaining thorough cooling of the reverse surface of the belt, is necessary, in continuous casting, for truly satisfactory results and a desirably high production rate of accurately dimensioned strip having good surface and internal properties. In particular, it has been found that arrangements and procedure for maintaining the described intimate contact between the belts and the metal, and for effectuating control for that purpose, should recognize differences in condition along the path of metal through the casting zone, including highly localized variations.

With these requirements in mind, the present invention is aimed at achieving a uniform and high cooling rate while compacting the solidifying metal and while maintaining satisfactory cross-section profile, e.g. a desired uniformity of shape of the cast strip, including uniformity of gauge and as close to a flat, plane surface on both sides as possible. The nature of solidification of the metal, both at successive general zones along the path and at places where localized irregularities may occur, needs to be considered in control of the process. There should be attention to the amount of metal in fluid state at any zone or place, the effect of its metallostatic head on the belt (either directly or through a shell), and the nature of the solidifying shell at each face of the mold; i.e. whether a weak agglomerate or particles, a solid but flexible shell, or a rigid shell becoming integrated with the shell on the other face.

In some prior apparatus, there have been arrangements where the guiding or support means for each belt along the casting path, such as a set of rollers or the like spaced along and across the path, have been given some yieldability as a complete, unified assembly, or where a transverse row of such rollers or elements across the belt path has been given a resilient mounting which tends to push such unitary set of rollers (as a whole) continuously against the belt and the belt correspondingly against the metal, but these proposals have failed to appreciate the localization, by zones or as to small, random places, of the problem of contact between belt and metal. Experience has indicated that trouble due to a local separation, even very slight, between the solidifying shell of the metal and the adjacent belt surface, can become progressively severe, in the sense that with such failure of contact, the normal heat transfer and temperature conditions at the surfaces of the metal and belt and through the belt are changed in this very local spot, with the likelihood of resulting thermal distortion of the metal shell and/or belt, that may in turn create further separation at adjacent localities, and still further thermal effects.

The foregoing difficulties can become particularly troublesome in attempts to increase the speed of continuous casting, or to cast relatively thin strip with high accuracy, or to cast an alloy where solidification occurs over a range of temperature, with corresponding delay in reaching a frozen shell of fully solid strength. An important object of the invention is therefore to provide improved methods and apparatus for continuous casting, wherein superior contact is maintained with the metal, and with correspondingly superior cooling and superior control of the dimensions of the product.

Other areas wherein the objects of the invention aim for improvement in belt casting apparatus and procedure are with respect to: the general organization of the equipment particularly for mounting and retaining the belts in exact position as desired; the efficiency of handling and utilizing liquid coolant for the belts; and instrumentalities for controlling the transverse profile of a belt at the mold space, so as to achieve desired, uniform, dimensional accuracy of the cast strip. As stated, despite useful recent advances, particular problems have nevertheless been found to reside in the control of the process for maintenance of continuous, adequate cooling and positional stabilization of the belts, against undesired shape or internal defect of the casting, or uneven surface or breakouts, a special need being to take account of varying requirements along different zones of the casting path, as well as varying difficulties that may occur in highly localized ways.

SUMMARY OF THE INVENTION

To the foregoing and other ends, certain important aspects of the invention involve the provision of arrangements for guiding and supporting a casting belt in its path along part or all of the actual mold space by a multiplicity of guiding elements or faces distributed both lengthwise and crosswise of the belt path, which are so circumstanced that with respect to each element or face individually, the belt can shift locally in position, in a direction perpendicular to the mold space, relative to a predetermined path-defining position of the element or face. In one particular but important sense, realization of this condition of local compliance in the guiding of the belt involves the provision of yieldability individually at many places both across and along the belt path, being yieldability from the predetermined guiding position, against a loading force, in a direction outwardly of the mold space.

Presently contemplated embodiments of this feature of yieldability involve yieldable mounting or support of the individual guiding elements arranged so that displacement of the element outward is resisted by a loading force; a particularly effective construction includes means whereby the element is biased toward a base or nominal guiding position and is displaced only when the belt exerts force exceeding the selected or limit value of the biasing force. The yieldable mounting may be resilient, or its load may have a resilient component, such being indeed a matter of present preference so that if the force exerted by the belt is sufficient to overcome the limit or threshold load and displace an element, there is no tendency for the element to move further outward than necessary to accommodate the cause of the force. In all cases, however, if the force on the belt is caused for example by rigid solidification of the travelling metal to such thickness as to require slightly more mold space than will fit the preset guiding position, the belt moves outwardly as needed but no further, while the load on the element (preferably with some resilient effect) can act to keep the belt in as much contact with the metal as desired, for continuance of optimum cooling.

Another aspect of the invention, which may be of significant utility in many cases, is the provision of a minor range of compliance relative to the belt support, e.g. at force levels (even little or no force) which are well below the load to be overcome by solid metal as above. This small positional freedom of the belt, being usually an effect of minor compliance, is advantageously afforded by means that may be related to individual support elements or local areas and may preferably be adjustable in range of positional movement of the belt or in modulus of compliance.

Although this last-mentioned concept can be carried out in other ways, a very effective embodiment of it makes use of a coordinate invention (described hereinbelow but embraced, of itself, in another patent application) which involves the provision of many individual elements or local areas collectively backing up the reverse surface of the belt and having jet apertures and adjacent liquid withdrawal means so as to provide a thin layer of high-velocity liquid coolant between each element face or area and the belt. With this arrangement, the belt is efficiently cooled by a layer of coolant over its entire surface and is effectively spaced from the supporting faces by such layer, whereby the belt is essentially freed from rubbing frictional contact in its passage along the casting space. By suitable control of the circumstances of the liquid coolant layer, as with respect to the pressure in the space that contains it and correspondingly as to any difference of pressure between opposite sides of the belt such as to pull the belt against the layer (and thus in effect against the guiding faces), the above-described minor positional freedom or soft or stiff compliance for the belt can be achieved to any desired degree.

It should be understood that utilization of the liquid bearing, coolant principle may be adopted in embodiments or methods of the present invention without regard for any significant compliance or softness within the liquid bearing layer itself, as, for example, in a situation where by reduced pressure or other means the belt is forced firmly outward of the mold space and through the bearing layer against all the guiding faces, there being then no contemplation of decrease in such outward force. The procedure of certain presently preferred aspects of the present invention, however, involves the employment of some relatively soft compliance or the like, of selected modulus, in the liquid bearing layer over one or more sections of the mold space.

Considering the process as embodied in a practical example, it appears that in the entering zone of the casting space between the belts, the metal may behave essentially as entirely fluid (any belt-adjacent shells being too thin and too weak to be of consequence) and by preference the belts should be held firmly against their supports, with the liquid layer (if used) in between. Although good operation is believed attainable in at least a number of cases with like firm stabilization of the belts throughout the length of the mold space, a presently preferred step in the procedure according to this invention, i.e. beyond the first step considered as performed in the above first zone, involves the employment of a considerable compliance or softness of support in the liquid bearing layer at a further zone (or zones) of the casting path.

In such zone, (1) the nature of the shells or skins formed or forming adjacent to the belts, the shells being essentially solid and having some firmness per se yet still susceptible of bending or distortion and even in some instances more like a cohered layer of particles rather than entirely rigid, and (2) the relation of such shells to the essentially still fluid metal in the interior of the travelling material, may require more local freedom of the working face of the belt, so to speak, than the belt has with a relatively hard stabilization toward the supporting surface. Thus in such zone or zones the reduced pressure on the reverse surface of the belt or other pressure difference or like condition pulling the belt toward the guide elements may be relaxed or lessened so that slight, local movements of the belt can occur toward and away from the center plane of the casting space, allowing the belt to remain in best contact with the surface of the metal shell without disrupting the shell. This will tend to accommodate slight local depressions in the metal surface or slight unevenness of the belt supporting surface and will avoid local losses in heat-removing contact which can cause thermal distortion of the belt or the metal shell and progressively further loss of contact and further distortion.

As will be understood, these concepts of controlled firmness or softness in the stabilization of the belt to suit different zones of condition of the cast metal along the belt path are capable of coordination, for presently contemplated advantage, with the concept of highly localized yieldability, against suitable loading, over one or more zones of the belt path, preferably at least regions where the metal is approaching rigid solidification and where closeness of the belt to the metal surface remains necessary. Effective embodiment of the foregoing is achieved with guide-faced cooling elements providing the rapidly flowing layer of liquid coolant, each individually movable so as to yeild when the belt exerts force on it, through the coolant layer, that exceeds the loading force on the element.

It is particularly desirable in at least may cases to provide mutually converging paths for the belts, so that the mold cavity, considered over-all, has a tapering configuration from the liquid metal entrance to the locality which may be deemed the exit, where the strip has fully solidified. This taper may be of differing character over various sections of the path, or the belts may be parallel at one or another of the sections, but a primary function is to compensate for shrinkage of the metal in solification, as may be done quite exactly with the preferred structures and procedures of this invention. Indeed, it is conceived that the tapering path may preferably afford a slight overcompensation which is then taken up by the yieldability of the elements, for best assurance of complete belt-metal contact and correspondingly complete continuance of cooling as the metal reaches total solidification, yet without hazard to the belts, other structure, or cast product.

Although the foregoing outline of procedure has dealt with succeeding zones along the casting path, in the sense of zones where the constitution of the traveling metal body may fall in several categories — e.g. as being essentially all fluid, or having shells that are at least somewhat self-supporting with a fluid center between them, or having shells with sufficiently solidified connection to behave as a solid mass — a further aspect of the invention involves the arrangement of the belt guiding means, specifically the guiding and cooling means, in the form of successive, separate sections, advantageously three or more, along the mold space, which can have different characteristics of compliance, yieldability and the like. Indeed, very preferably the sections can each be adjustable or adaptable in such respects for universality of application of the apparatus to a wide variety of casting requirements.

For example, solidification characteristics of metal in the case of aluminum and aluminum alloys vary considerably, as to percentage of shrinkage, as to actual temperature of solidification, whether a fairly sharp point for pure aluminum or over a considerable range for some alloys with corresponding problems of liquid-solid conditions and possible segregation in the metal body. Consideration must also be given to the thickness of the strip to be produced, it being often more difficult to achieve dimensionally accurate casting for thinner strips as in the range of ¼ inch or smaller.

A notably useful characteristic of the improved sectionalized arrangement of the belt-stabilizing and cooling means is provided by the construction of the sections and their support such that any desired configuration of belt path can be readily provided, at successive sections whereby each individual section may afford a taper of a belt toward the mold space, or a parallel relation with the central plane of the mold space, as may be required to suit the needs of the complete operation or the special needs of the successive zones of the casting process.

For accommodating all of these situations, the procedure of the present invention is readily adaptable and contemplates adjustability in the various ways mentioned above, while the apparatus, constituted in successive separate sections which are designed or adjustable as has been described, is of special utility in the performance of any desired process or sequence of treatment, whether with difference or similarity of conditions as the metal travels from entrance to exit.

A further feature of the improved apparatus resides in provision for adjusting the contour of the mold space, crosswise of the path of solidifying metal. It is known that in some cases of commercial significance, the course of freezing of the metal involves formation of solid shells immediately next to the belts, with solidification progressing inwardly of the strip. In preferred operation with the cavity tapered toward the exit, the actual thickness of the cast strip is in a sense dependent on the point at which it has acquired sufficient stiffness to push the belts apart against the resilient loading. Since the last part of the strip to solidify is usually the center portion, between the shells and between the edge regions, there is a tendency to force the central fluid metal backward toward the mold entrance and thus to cause the solid strip to come out with a concave profile.

It is therefore desirable to adjust the crosswise contour of the mold, e.g. to camber the cavity in such a way as to correct the negative profile with a positive offset. The invention therefore provides effective means for bending one belt guiding assembly or sections of it, for example at a center locality crosswise of the belt path, such contouring being effective relative to the mold cavity so as to cause the transverse profile of the belt, facing the metal, to assume a concave shape to the extent required by casting conditions. In consequence of this adjustment, the ultimately solidified strip may have properly plane faces.

Another improvement herein, having procedural advantages, is realized with arrangements whereby the liquid coolant, e.g. water, is circulated in an essentially closed path that includes cooling the reverse faces of the belts with effective recovery and recirculation of the water. A special feature of the process resides in recirculating the water at a controlled, elevated temperature, e.g. in the range of about 40° to about 70° C. Use of warm water has positive advantages in heat removal, for the cooling function, and it contributes to reduction of the atmospheric condensation onto the belt that has been troublesome on prior apparatus operated with open water flows at ambient temperatures. For optimum results, the process may also include subjecting the water to appropriate treatment, for instance to maintain a content of an inhibiting agent, for prevention of corrosion and formation of deposits in the passages of the cooling system.

In the apparatus described herein, other mechanical features are improved in a manner that coacts with the various elements and functions described above, including the structure and support of the carriages of the casting belts, particularly in reference to means whereby the upper carriage can be raised and lowered for removal of belts of both carriages, adjustment and servicing of the guiding and cooling means and the like.

All of the foregoing features of procedure and apparatus are set forth more completely in the following description and the accompanying drawings, with additional aspects and details of improvement and special advantage, all conceived as parts of the present invention.

BRIEF DESCRIPTION OF THE DRAWINGS

FIG. 3 is an enlarged fragmentary section of the belt-bearing structure in FIG. 2, taken for example of line 3—3 of FIG. 2.

FIG. 4 is an enlarged fragmentary section corresponding to a part of FIG. 2, shown as a section parallel to the section plane of FIG. 2 but displaced from it by a small distance.

FIG. 11 is a simplified elevation of the entry end (left-hand end in FIG. 1) of the apparatus with a portion in section, as on line 11—11, of FIG. 8.

FIG. 12 is a horizontal section on line 12—12 of FIG. 11.

FIG. 13 is a vertical sectIon on line 13—13 of FIG. 11.

DETAILED DESCRIPTION

Figure 1:
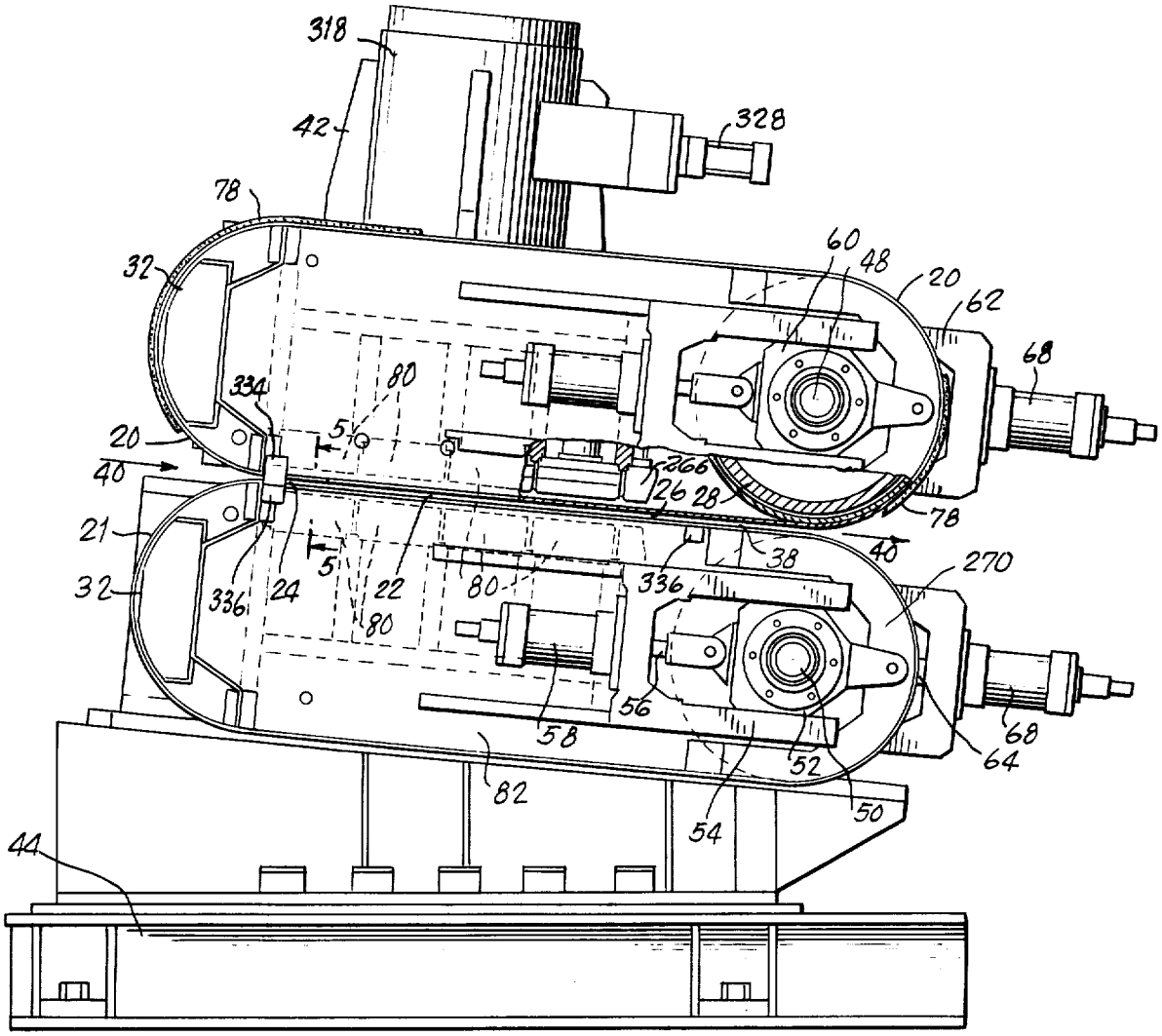
FIG. 1 is a general side view, chiefly in elevation but with a portion in vertical section, of a twin-belt casting apparatus embodying the features of the present invention and thus constituting a representative example thereof. For comprehensively indicating most of the apparatus, this view is on a smaller scale than the further views, which also differ in scale among themselves as will be readily seen.

In the drawings, the various features of the invention are shown as embodied in a belt casting machine in which a pair of resiliently flexible heat conducting belts, e.g. metal belts, are endlessly drawn through a region where they are substantially parallel to each other, usually with desired convergence, so as to define a suitable mold space. Molten metal is continuously supplied into this mold space while the belts are cooled at their reverse surfaces, so that the metal solidifies and continuously emerges as cast strip. For clarity of illustration, various structural and mechanical details that do not directly pertain to the invention are omitted or shown only in simplified or schematic manner. Such parts and details include, for example, further details of the main supporting frame and of the frame structure within each belt loop, motor and gearing connections for the belt driving rolls, details of the systems for supply of cooling and other water, and various other auxiliary instrumentalities, all of which will be understood as needed but readily provided in conventional manner or otherwise by ordinary skill, in the light of the following description.

In the illustrated apparatus, the path of the metal being cast, although it may in other embodiments be more oblique or even vertical, is substantially horizontal with a small degree of downward slope from entrance to exit of the actual casting space. Thus the upper and lower endless belts 20 and 21 are arranged so that their faces are essentially parallel to each other (FIGS. 1 and 2) through the region where they define this casting space 22 from its entrance 24 to its exit 26. As will be appreciated, the belts are guided through suitable oval or otherwise looped return paths between their localities 26 and 24. In the present machine, the belt paths are essentially identical ovals, in symmetrically reversed relation above and below the zone 22. Thus the upper belt 20 passes around a cylindrical driving roll 28 and then travels along an upper path where it may be further supported, if desired, by rows of idler rollers 30 or the like, FIGS. 14 and 15. The ultimate return about a further semicylindrical path, for this upper belt 20, is achieved by a special liquid-layer, bearing arrangement generally designated 32 and particularly illustrated in FIGS. 2, 3, and other views. The lower belt 21 follows an essentially identical path including a drive roll 34 and a final, semicylindrical return bearing 32 similar to the bearing 32 above.

For handling convenience, and for avoiding damage due to overheating of the less efficiently cooled belt if in hard contact with the cast strip the solidification of which is intended to be finished by the time it reaches the exit locality 26, the belts 20, 21 may continue in somewhat parallel relation through a region 38 beyond the exit locality, with some sight divergence (if desired), all as indicated in FIG. 1. The path of metal is so indicated by the arrows 40 in the several views. The belts themselves are constructed in appropriate manner for casting apparatus of this type, being advantageously of metal, for example, suitably flexible but stiffly resilient steel of appropriately high strength and of such nature that it can be sufficiently tensioned without inelastic yield.

The apparatus, and particularly the belt-carrying structures, can be supported from or in any desired type of framework such as generally indicated by the upright structure 42 and lower or base structure 44 in FIG. 1, all arranged, as will be understood, to hold the belt holding frameworks or carriages in adjustable, pre-set spacing and preferably with improved provision (described below) to permit moving the carriages apart, for insertion and removal of the belts and other servicing as necessary.

The belts may, if desired, have a conventional surface treatment, e.g. a thermal insulating coating facing the mold space, but in the illustrated machine, the preferred water cooling arrangement keeps each belt at a relatively low temperatures at its surface next to the metal, so that efficient heat removal is achieved, and the usual belt coating may need less insulating function to avoid high temperature gradients and corresponding belt-buckling thermal stresses, internally of the belt.

Figure 14:
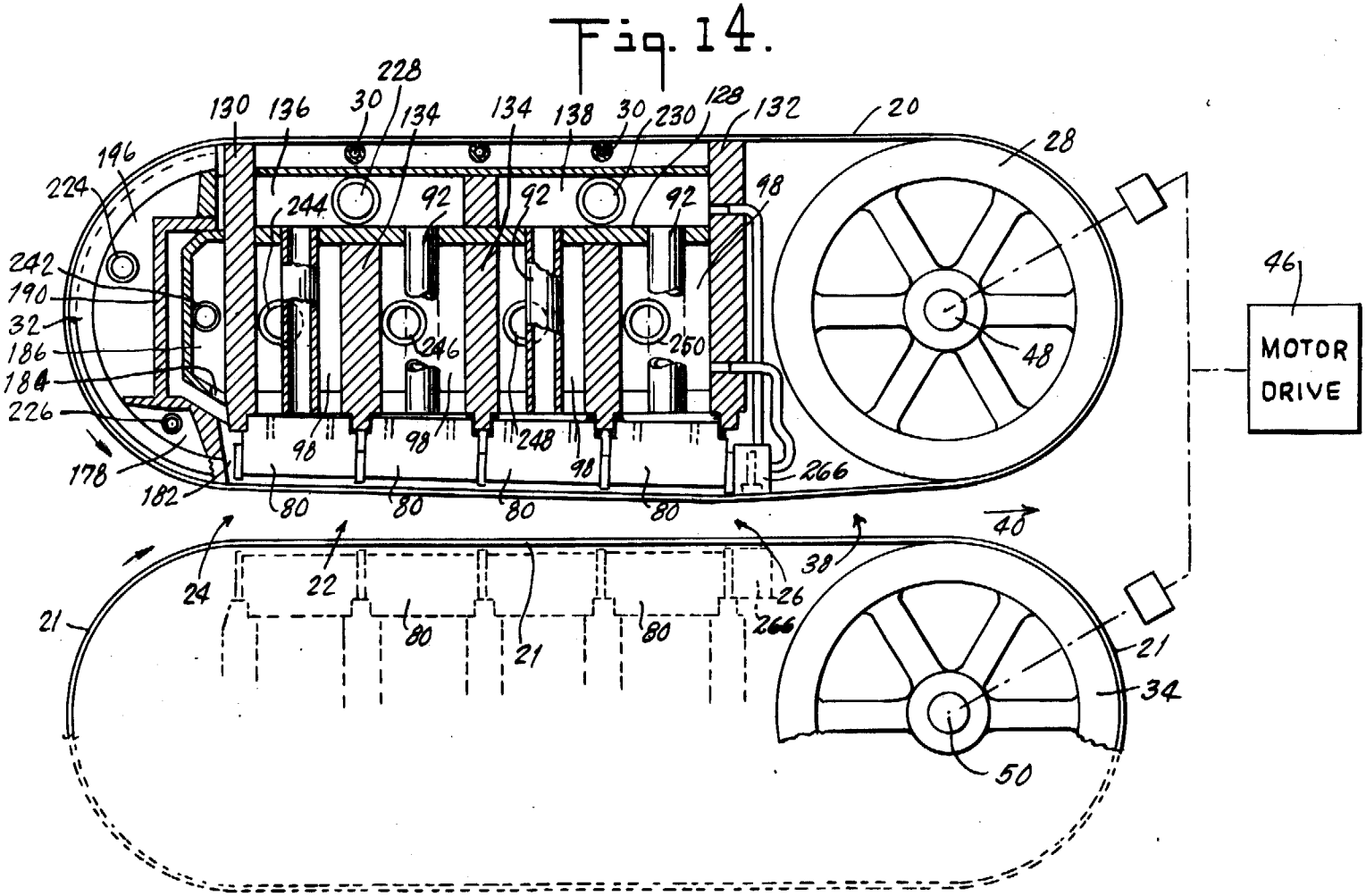
FIG. 14 is essentially a diagrammatic side view, greatly simplified, corresponding to portions of the view of FIG. 1 but with various structural details omitted, this view and FIG. 15 being designed to illustrate schematically the supply and withdrawal of cooling and belt-supporting liquid, and also the positioning of the several groups of guiding elements. Certain features and arrangements including the taper of belt paths have been very greatly exaggerated for purpose of illustration.

The belts 20, 21 are respectively driven by the rolls 28, 34, as schematically indicated in FIG. 14, with a motor drive 46 having appropriate connections to the shafts 48, 50 of the drive rolls, including suitable gearing and other necessary drive coupling (not shown) as will be readily understood. Although other tensioning means may be employed, the apparatus as shown (FIGS. 1 and 15) includes fluid cylinder means for positionally adjusting the shafts 48, 50 and holding them with appropriate tension on the respective belts. As seen in FIG. 1, one end of each of the shafts (e.g., shown for shaft 50) is carried by a journal bearing 52 arranged to be horizontally displaced either way in the direction of the length of the mold space 22, in a sliding support 54 and to be so positioned by a piston 56 in a double-acting hydraulic cylinder 58. The other end of the roll shaft, e.g. as indicated at the shaft 48 of the roll 28 (FIGS. 1 and 15), has a similar journal bearing structure 60 sliding in a support 62 and connected to a piston 64 of a similar double-acting hydraulic cylinder 68.

Although not all of these elements are actually here shown for both rolls, it will be understood that the shafts 48 and 50 of the two driving rolls are thus each supported at their ends by journal bearings as described, each pair of journal bearings for each roll having respective positioning cylinders 58 and 68 so that by appropriate adjustment of the cylinders the drive roll can be located to hold the associated belt in suitable tension for belt-driving operation and other proper functioning of the belt as described below, such adjustment including, if desired, the attainment of a desired exact alignment of the roll axis if required by slight angular movement of the axis in a horizontal plane. It will be understood that although the cylinders 58 and 68 are shown for structural convenience as extending in opposite directions at opposite sides of the assembly, their function is the same as if they both extended in the same direction for each roll.

Figure 2:
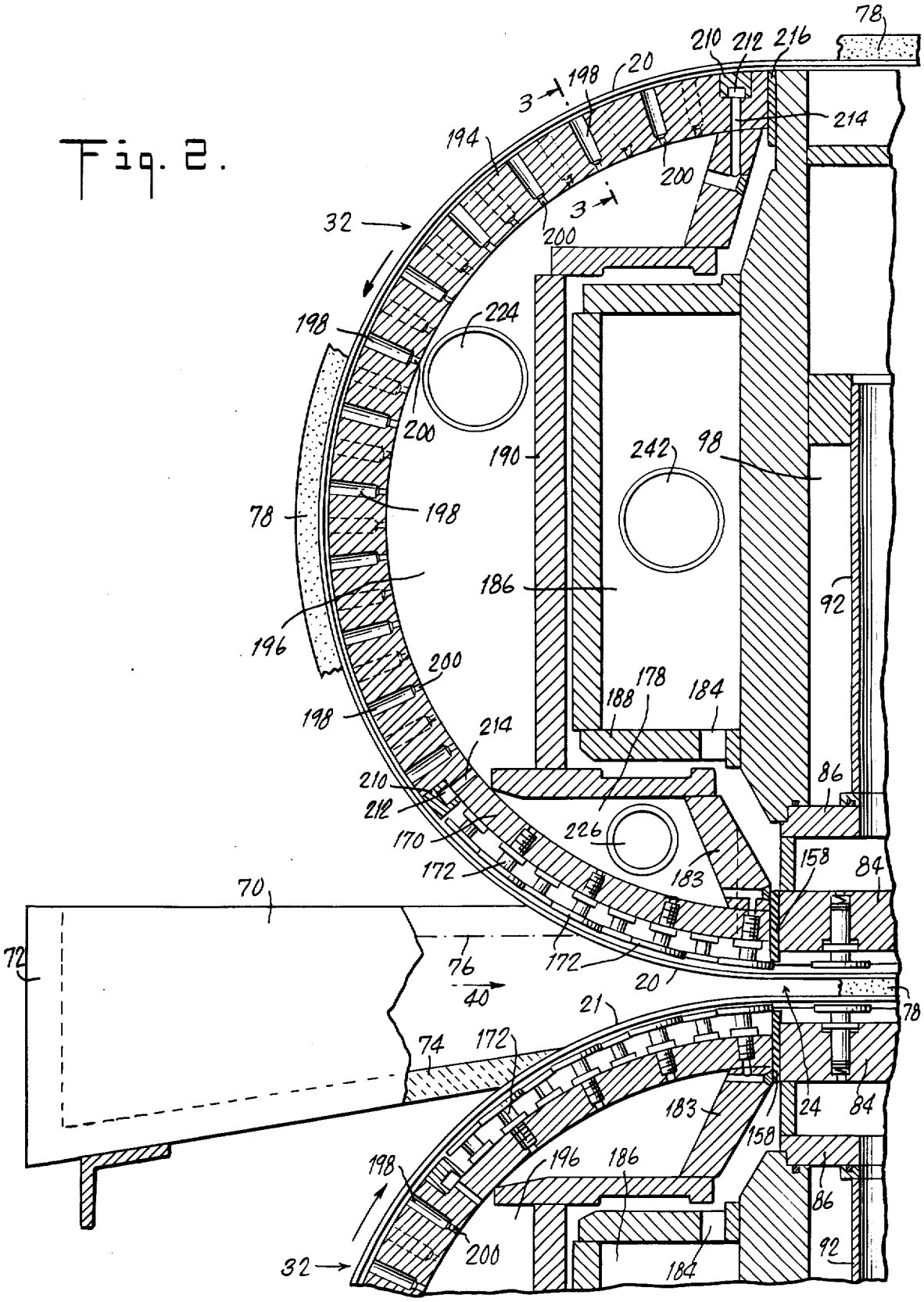
FIG. 2 is an enlarged vertical section of a part of the apparatus of FIG. 1 at the left-hand end, showing details and further elements that were omitted from FIG. 1 for simplicity.
Figure 15:
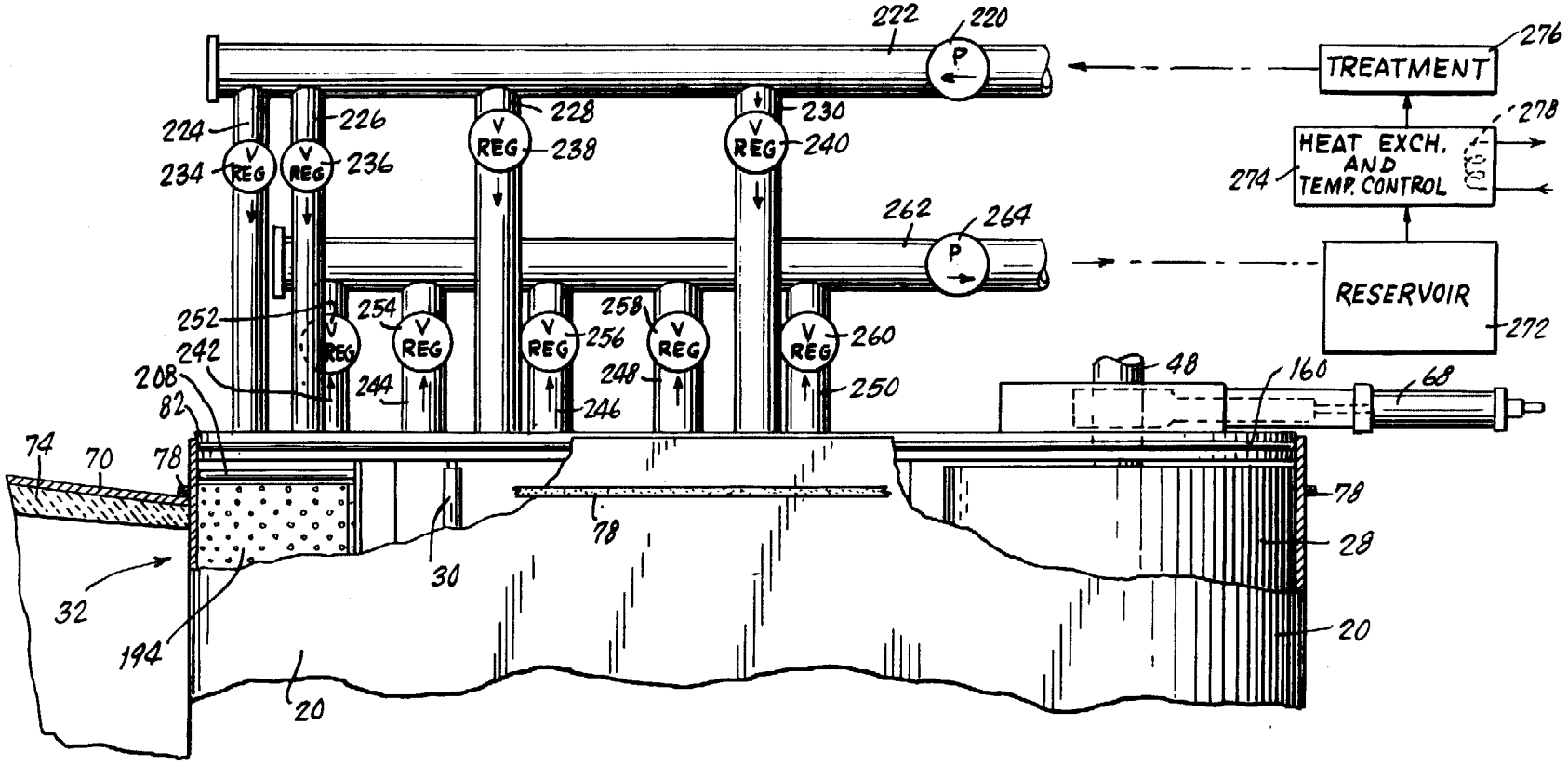
FIG. 15 is a similar, simplified largely diagrammatic view, chiefly in top plan but with some parts in section, of the apparatus as shown in FIG. 14.

Molten metal is supplied to the casting zone 22 by a suitable launder or trough 70 which is disposed at the lefthand end of the apparatus as seen in FIGS. 2 and 15, and which may have a structure that is generally of appropriate, known sort, including a suitable front port in the wall 72 whereby liquid metal is continuously supplied, with a suitable duct from a furnace or the like (not shown). The launder 70 is lined as at 74 with refractory material. Although in general the prior practice has been to supply the metal more or less directly to the entrance 24 of the parallel portion of the belt paths and in a depth about equal to the belt spacing, and although such practice may if desired be followed with the presently improved machine, it is here contemplated that the launder 70 have a vertically much taller body so that the supplied molten metal, e.g. up to a level 76, forms in effect a deep pool, coming in contact with the belt 20, 21 at localities well ahead of the mold entrance 24. Thus for instance, the metal meets the mutually converging belts as illustrated in FIG. 2, or may even meet the belts at places further back from the entrance 24, along special regions of the curved belt-bearing supports 32, 32 as described below.

One useful construction involves bringing the liquid metal to a significantly greater depth on the upper belt, i.e. up along the upper bearing 32, well ahead of the point of nip or entrance 24 of the casting space, while getting the metal into contact with the lower belt at little or no distance (over the lower bearing 32) upstream of the nip point 24. With this or other arrangements for providing a deep supply pool of metal, there is special advantage in having such a pool which serves to keep the metal quiet and to eliminate turbulence as it gets into the actual mold space 22. There are in consequence fewer surface irregularities and fewer internal defects in the cast strip, i.e. smoother, better surfaces and better homogeneity of microstructure. The special cooling (described below) of the curved portions of the bearing supports 32 and 32 nearest the mold entrance 24 cooperates in avoiding undue thermal shock or stress in the belts.

As is usual in belt casting machines, the apparatus is provided with edge dams, necessarily at least one at each side, so as to complete the enclosure of the mold cavity 22 at its edges. Thus, as indicated in FIGS. 1 - 3, 5, 6 and 15, a pair of edge dams 78 of rectangular cross section are shown moving with the upper belt 20, being carried at the exposed surface of the belt near its respective side edges. Although other edge dam constructions, preferably of flexible or articulated arrangement and moving with one or both of the belts, can be employed, a suitable dam 78 may be a compressible, heat-resistant strip consisting of a metal wire or other core surrounded by woven or like layers of asbestos or other refractory fibers. Each dam 78 can be temporarily adhered to one of the belts, e.g. the upper belt 20, as an endless strip coextensive with the belt. Whether so retained or otherwise guided, the dams are held in suitable longitudinal positions so that when they are compressively engaged between the belts they close the cavity edgewise at the desired transverse dimension and thus keep the molten metal precisely in the path where it is fully cooled through the belts as described below. In this way the dams 78 define the width of the cast strip. The same can be designed, as by their described compressibility, to accommodate small differences in the spacing of the upper and lower belts 20, 21, as occurs for example along a slight converging taper from entrance to exit of the mold space.

The system of cooling the belts (along the casting zone 22), which most advantageously also serves to stabilize the belts in their desired paths, is illustrated in FIGS. 1, 2, 4 - 6, 9, and 14, and in accordance with a preferred aspect of this invention, is divided into a succession of unit assemblies or sections 80, which may be called cooling pads along the course of each belt. Although other cooling or supporting arrangements can be employed along either belt path or at one or another of the succeeding sectional localities, the several cooling pad assemblies 80 are here shown as all identical for both belts 20 and 21. Each pad 80 comprises a boxlike support which may extend entirely across the path of the adjacent belt, between and fastened to heavy side frame plates such as member 82 in FIG. 5, there being one such member at each side of the upper and lower belt carriages. The enclosing structure of the pad 80 may have a horizontal platelike member 84 nearest the belt path, another plate 86 spaced from and parallel to the member 84, and a square frame 88 completing the box and forming side walls for the space 90 between the plates 84 and 86.

This space 90 is designed to receive a supply of water, as liquid coolant, through one or more large pipes 92 each fitted to a corresponding opening 94 in the plate 86. The region outside of the plate 86, i.e. remote from the belt 21, communicates for liquid flow through passage 96 that extend through the box to such region from the space outside of the plate 84 that is closest to the casting belt. Such passages 96 through the box (traversing the plates 84 and 86) thus serve to carry the discharge of cooling water from the side of the pad 80 adjacent to the belt, to the region 98 on the other side from the belt, where such water is collected for removal. The passages 96 are constituted by sleeves 100 where they traverse the space 90. There are preferably many of these passages 96 distributed laterally throughout the pad, but so disposed as not to coincide with the opening or openings 94 or with further smaller openings (described below) in the plate 84 through which the high-pressure liquid is directed.

The cooling and support of the belt is accomplished by a large multiplicity of guide-faced cooling elements 102 (FIGS. 4 to 7) distributed throughout the belt-adjacent plate 84 of the pad 80 so as to present a substantially continuous and substantially level surface which can precisely define the contour desired for the belt path, and next to which, with a small liquid-layer spacing, that belt is therefore designed to travel. Each of these elements 102 comprises a wide portion or head 104 that provides a circular belt-facing surface 106, and a shank portion 108 of cylindrical, tubular configuration seated with axially sliding fit in a corresponding recess 110 of the supporting plate 84. The hollow interior 112 of the guide element shank 108 is fairly wide throughout most of its length but closes to a narrow jet aperture 114 through the center of the face 106, which in turn has a centrally, very slightly concave shape as indicated with some exaggeration of its depth in FIG. 5, the shape being a very shallow cone surrounded, if desired, by a narrow annular land, i.e. plane area. Although these elements, particularly as to their belt-guiding faces 106, may have other peripheral shapes (e.g. rectangular, triangular, elliptical or otherwise polygonal or curved in plan) and other than the shallow, conical concavity shown (e.g. a very shallow recess of coaxially cylindrical or spherical shape), the illustrated configuration of the circular face and the depression and jet opening are believed to be especially advantageous.

The interior of each recess 110 in the plate 84 opens through a short passage 116 to the space 90 between the plates 84 and 86 of the cooling pad, which opens into the related supply pipe or pipes 92, whereby high-pressure liquid coolant, e.g. water, is directed into each of the elements 102 and caused to jet against the belt through the nozzle opening 114. The shank 108 of the cooling element is sealed within its recess 110 by a suitable annular seal 118 (such as an O-ring, if desired) in a circumferential groove in the shank, i.e. a rubber sealing ring to keep water from communicating between the spaces on opposite sides of the plate 84, but nevertheless such as to allow relative vertical sliding of the parts.

Advantageously, the element 102 is biased or loaded toward the belt, i.e. toward the casting space, by appropriate means, preferably having some compressible or yieldable character, such as fluid or spring means or other instrumentality of like function, or advantageously a combination of such means. Thus in the construction shown, the fluid pressure of the confined flow of water supplied to the element applies considerable loading force, beyond that required or consumed for directing the jet through the opening 114, e.g. by the pressure exerted on the lower end (FIG. 5) of the hollow shank 108 of the element and on the step 113 between the interior passage 112 and the jet opening 114. The loading is supplemented by special resilient means such as a compressed coil spring 120 between the bottom of the recess 110 (which is wider than the opening 116 through it) and the lower end of the element shank 108. In a presently contemplated mode of operation of the apparatus, the major part of the loading (i.e. the initial or base loading of the element) is effected by the force of the water (whereby the element yields only when the belt exerts a greater opposing force), with significant, resilient contribution by the elastic force of the spring 120, especially in governing the extent to which the force of the belt may displace the element 102.

For further guiding and restraining the element 102, it carries an annular flange 122 which seats, conveniently with a sliding fit, in a cylindrical recess 124, i.e. a coaxial enlargement of the recess 110, in the face of the plate 84 that is adjacent to the belt. Removable stop means are provided to engage the outer face of this flange 122, e.g. as indicated by the stop 126 in FIG. 5. For example, each of the stop elements 126 may be a disk disposed to overlap the flanges 126 of a group of nozzle elements 102, say three, each disk 126 being removable bolted on the plate 84.

Thus each element 102 is urged or pre-loaded against a stop 126 by the spring 120, and in operation also (and usually predominantly) by the force of the water flowing at high pressure, but if the pressure or force of the belt, for example exerted through the liquid layer upon the face 106 of the element, is sufficient to exceed the total limit loading on the element, the entire element can be pushed rearwardly against the spring 120. By this action, the spring is compressed, allowing the element 102 to yield to accommodate the excess force on the belt and permit the belt to move correspondingly outward of the mold space.

It is conceived that useful loading on a belt guiding or supporting element, such as the element 102, can be achieved by water pressure alone or spring force alone or by other suitable means of yieldable character (whether or not resilient, although preferably so), and indeed that in some cases, as with other provision for releasably holding the element in an initial position, or as in some parts of the belt path relative to the state of the solidifying metal, there need be no positive stop. The feature of providing bias on the element generally requires that there be means which serves a loading function by exerting an opposing force responsive to incipient displacement (or to tendency to displacement) of the element when the belt, for instance because of solidified metal against it, in effect pushes against the element. Special advantage, however, resides in the provision of pre-load, whether partly or wholly of elastic nature, against a stop, and the arrangement shown is presently preferred, where the water pressure is available to afford a substantial part of the pre-load, plus some preload due to the spring or the like, which upon actual compression then exerts an increasing and thus progressively greater opposing force upon displacement. The spring, of course, also serves to hold the element in desired place at non-operating times, when no water is supplied.

The cooling and supporting functions of the elements 102 advantageously involves the projection of the high-pressure jets of water through the central openings 114 against the reverse surface of the adjacent belt 20 or 21 so that the jet is turned into a radially flowing, preferably thin layer of water confined between the element face 106 and the reverse belt surface. This flow between and along the element and belt surfaces is very rapid, i.e. of high velocity, affording excellent heat removal from the metal belt. At the same time, the pressure and quantity of flow of the water is advantageously controlled, in a manner which will be readily understood, so that by the compressed, thin layer of water the belt is maintained in separation from the actual face 106 of the guiding and cooling elements, in a firm hovering relation, yet the belt can be forced toward the face, as by suction (such as may be produced by a desired subatmospheric pressure in the liquid layer) or by pressure of solidified metal, whereby the belt is stabilized in position. Hence, although the belt does not actually touch the element face, it can be considered as in effect held against it, i.e. through the intervening liquid layer.

In other words, the arrangement provides a liquid bearing for the belt, and a novel, highly efficient heat-removing action by virtue of the many individual jets, the rapid radial flows and the coacting immediate removal of water between the moving nozzle faces 106. Very preferably, such removal is effected at the periphery of each face, for example primarily through the triangular spaces between each three adjoining elements as shown (FIG. 6); in this or other suitable arrangement, water projected from one face does not have to flow across any other face.

Figure 5:
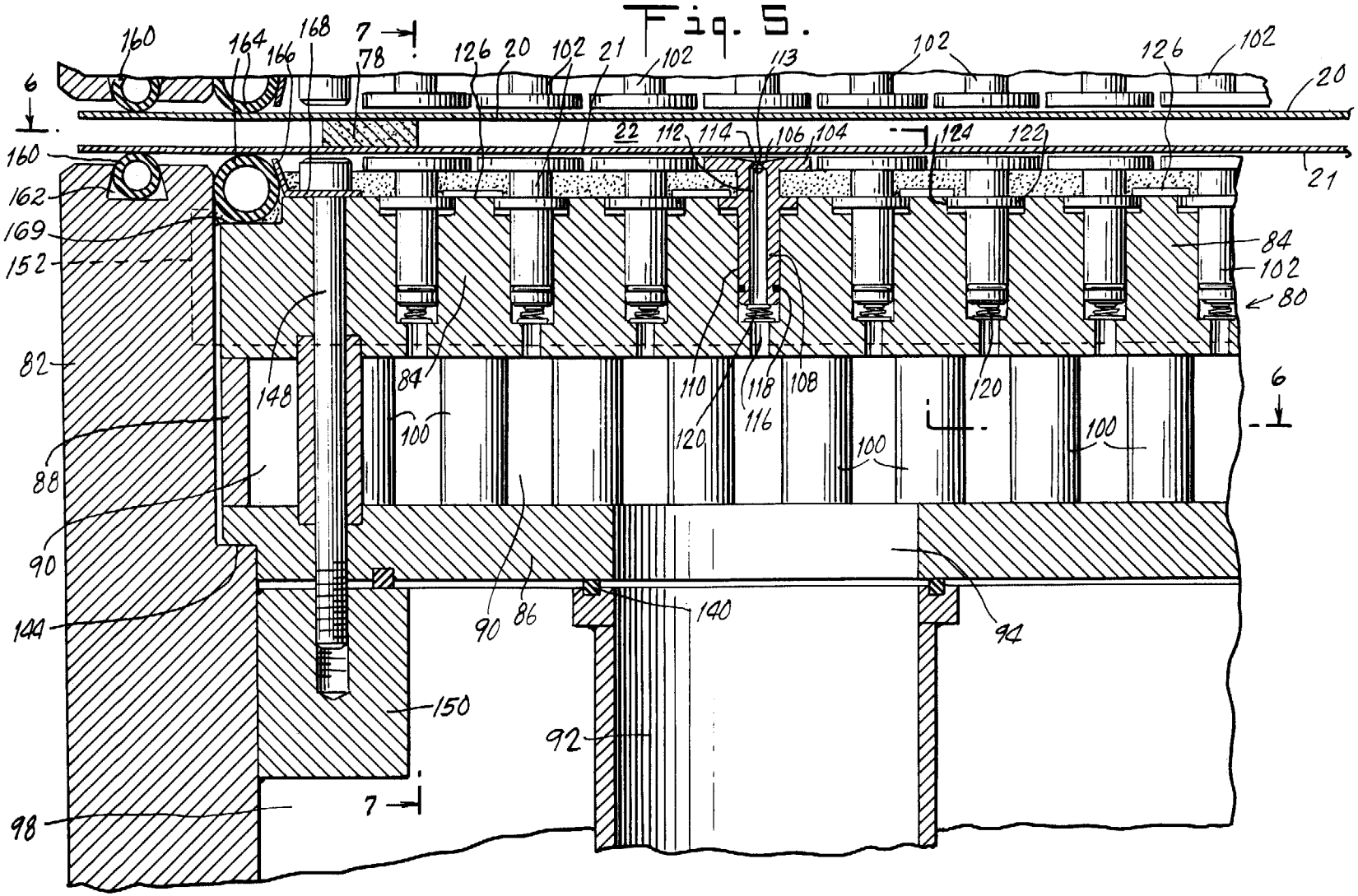
FIG. 5 is a fragmentary, transverse, vertical section, extending across part of the path of the belts, as on line 5—5 of FIG. 1, showing the guide-faced cooling nozzle elements with one of same in vertical section.

The water from the space above the plate 84 of each cooling pad assembly, being particularly the water coming into the space under the element heads 104, is drawn through the passages 96 into the space 98 which is itself enclosed by further frame structure of the belt carriage assembly. For example, each such space 98 is enclosed by part of a horizontal plate 128 (FIGS. 9, 10, 14), common to all these spaces, and by vertical plates transversely disposed across the belt carriage flame, being end plates 130, 132 and intermediate plates 134. At the side, these outlet chambers 98 can be enclosed by the main side frame plates 82, e.g. as seen in FIG. 5. The pipes 92, which carry the high-pressure water to the jet nozzles, traverse the chambers 98 and open into a chamber or chambers at the opposite side of the plate 128. For convenience, a pair of these high-pressure water supply chambers are shown at 136, 138 in FIG. 14, each supplying two mutually adjoining pads, although it will be understood that the separate pads 80 can be supplied individually, or from a single chamber or plenum. All of this depends chiefly on the extent of need for separate pressure or volume control of the supplied liquid coolant.

Advantageously the liquid supply and withdrawal system is so controlled that not only all the inlet chambers 136, 138 and 90 but particularly each chamber 98, as well as the entire space between the box of each pad 80 and the casting belt 20 or 21, can be kept at preset pressures. The arrangement is such that there is continuous contact of substantially the entire rear face of each belt with fast-moving water, and also permits effective control of the pressure at the reverse face of the belt, as for example in maintaining a subatmospheric pressure whereby a substantial pressure difference across the belt (independent of metal head or metal solidification) creates a force that pulls the belt toward the guiding element faces and in effect holds the belt against the faces through the intervening layer of water, thereby stabilizing the belt in its desired path.

It is not deemed necessary that these chambers and spaces be kept full of water, especially to the extent that air may leak in through the seals (described below), and may accumulate, notably in the drain chambers and spaces (especially in the lower belt carriage), for removal by pressure control valving and vacuum pumping means (not shown) which can extend from the chambers separately from the drain piping for water through suitable means (which may include barometric legs or the like) schematically shown in FIG. 15. As will be understood, the chambers and conduits for inlet water under pressure in both carriages are necessarily filled for continuous supply through the jet apertures 114 and corresponding maintenance of the complete layer of local high velocity water flows adjacent to the belts.

For optimum realization of the effect of the individual elements in cooling and guiding each belt, and also the cooperating effect of the preferred, individually limit-loaded arrangement of the support elements (a feature highly useful even in circumstances where the liquid layer bearing concept is not employed), there are a large multiplicity of these guide elements distributed in close spacing throughout the area of the belt path for which such guide and support is desired. In general, the invention contemplates at least several transverse rows of such elements, with at least several individual elements in each row across the path of the belt. Indeed, for casting apparatus having provision for casting strip even in widths as small as one foot (30 cm.) or so, it is believed that there should advantageously be for instance at least four or five individual elements in each row and at least five such rows (in the direction of belt travel), in order to obtain the individualized support effects throughout even a limited desired area. More specifically, in one practical example of the apparatus, these elements can have a face diameter of about 1.5 inches (3.5 to 4 cm.) and can be distributed across the belt path in nearly touching relation (and disposed in staggered relation in succeeding rows, whereby each element head 104 is close to two in each adjacent row); in such circumstances, to cool and support a belt for a casting width of, say, 30 to 40 inches (75 to 100 cm.), there can be as many as about 20 elements or more in each crosswise row.

It is presently believed that circular-faced elements 102 as shown as particularly desirable, arranged in a repeated hexagonal, i.e. staggered, pattern as apparent in the drawings, whereby small triangular-shaped openings are created in the otherwise essentially complete surface constituted by the element faces 104. As explained above, the water flow from the faces returns directly through these openings to the region which lies between the element heads and the outside of the plate 84 and from which the water passes into the space 98. Thus a significant, preferred feature is that the arrangement of slightly concave jet-directing faces (whether constituted as individual elements or integrated as many such faces in a single surface structure) have at least small openings between all of them whereby the liquid flowing across each defined face, radially from the jet, is directly withdrawn.

The pads 80 are fitted to the conduits 92 by rubber sealing rings 140 at the outer surfaces of the plates 86 (FIGS. 5, 7), while each pad is sealed to the adjacent face of the structure that constitutes the water outlet chamber 98 by similar sealing strips 142 extending entirely around and near the edge of the outer face of the plate 86. The pads can be adjusted in position toward and away from the belts, by inserting shims at localities indicated at 144 and 145, particularly at the four corners of the plate 86 (see FIG. 14), while the elasticity of the rubber sealing elements 140, 142 keeps the chambers 90 and 98 closed by the plate 86.

As shown in FIG. 5, the pads can be secured in place by long bolts 148 extending from the belt-adjacent face of the plate 84 through the plate 86 to appropriate projections or abutments 150 of the side plates 82 of the belt carriage assembly. By such other means at each side of the carriage, each cooling pad 80 is removably secured in place, while its position toward or away from the casting space, parallel or at any slight angle to the central plane of the latter, can be precisely determined (and the desired belt path can be correspondingly determined) by the inclusion of a suitable number of shims, or no shim, at the above-described shoulders or steps 144, 145, between the corners of the pad and the structures against which the pad seats.

Figure 6:
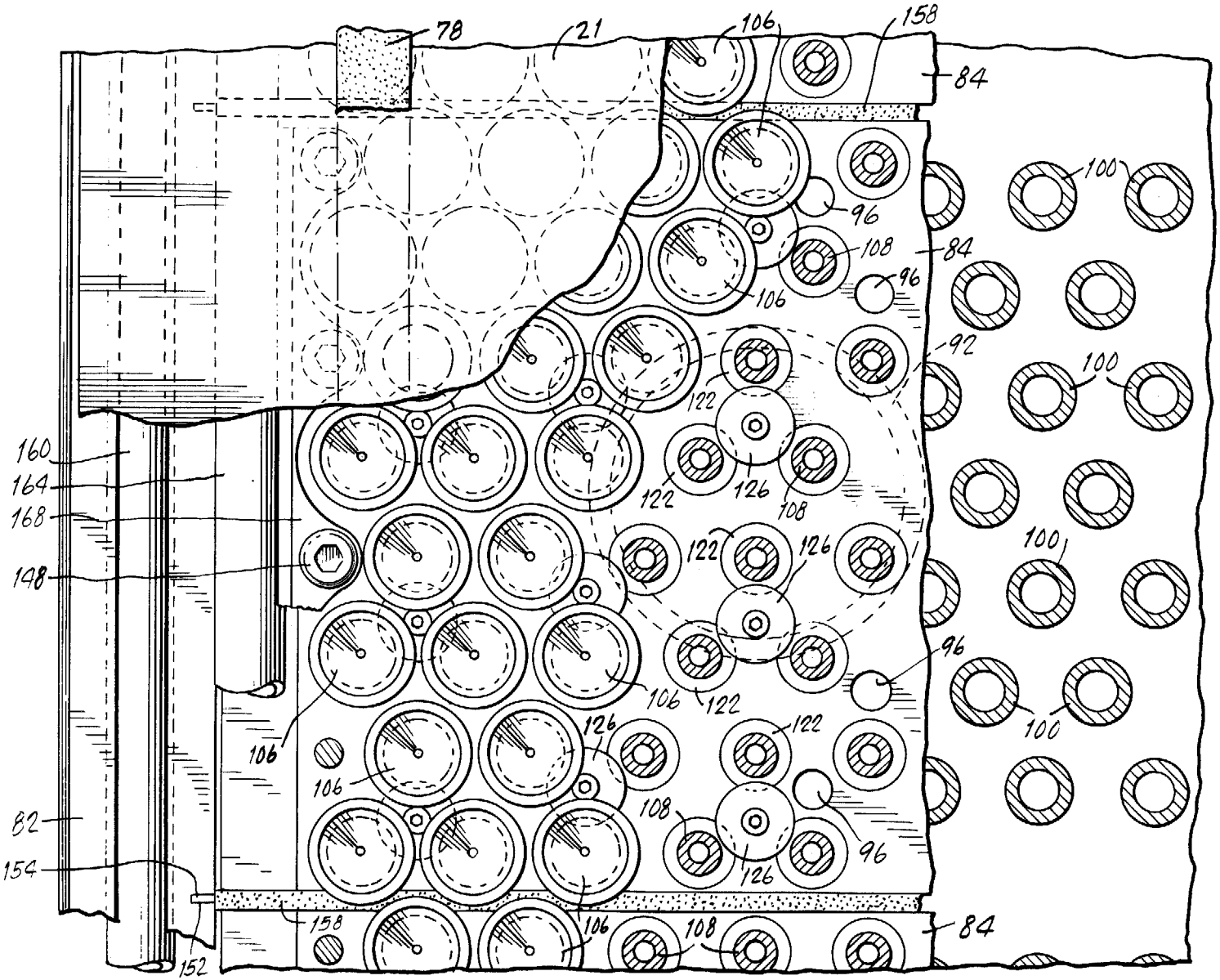
FIG. 6 is a fragmentary, generally horizontal view taken in parts respectively on different parallel planes as indicated by the line 6—6 of FIG. 5.
Figure 7:
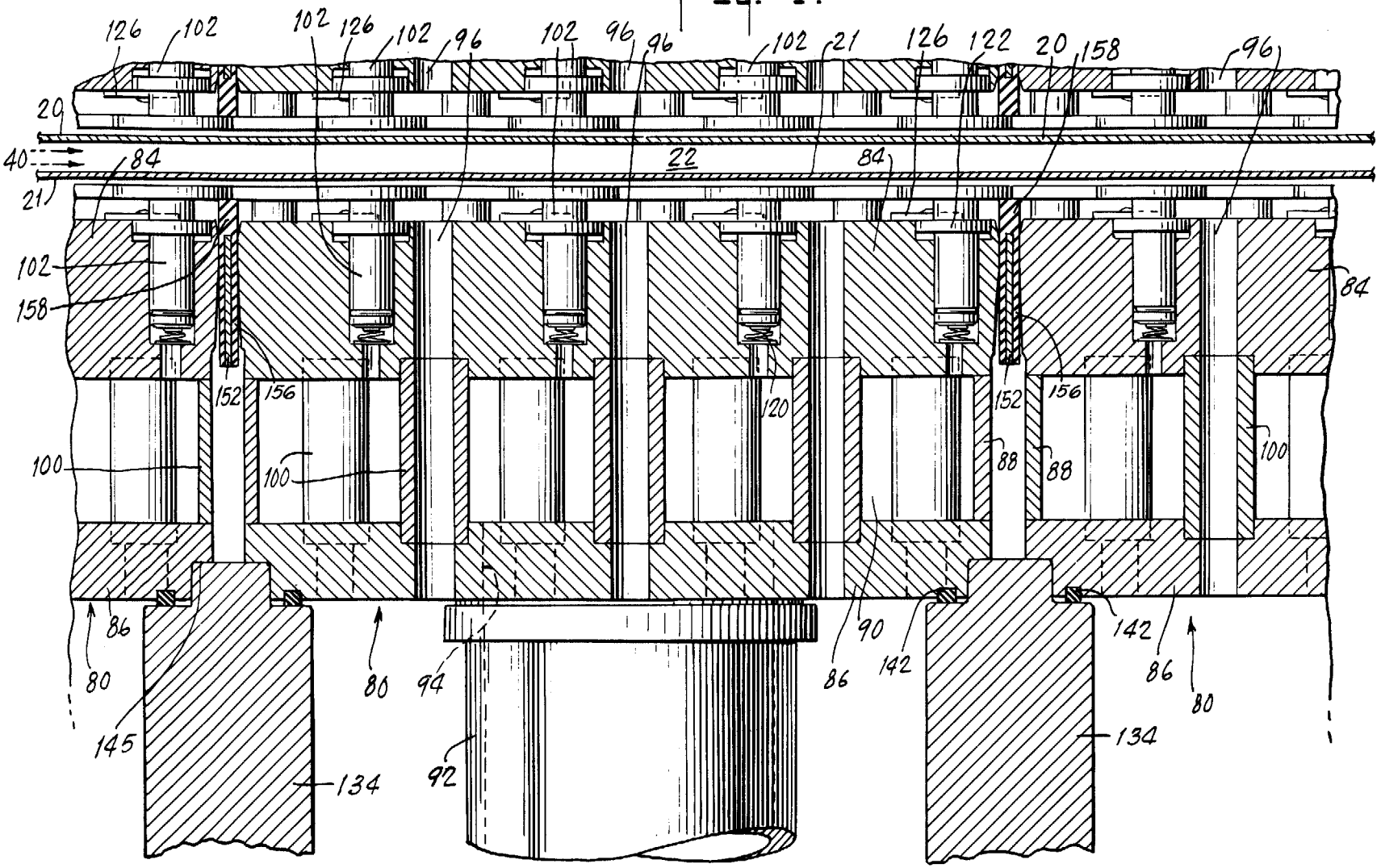
FIG. 7 is a fragmentary vertical section on line 7—7 of FIG. 5.

Especially to facilitate individual control of the pressures maintained at the reverse belt surface by the liquid coolant of the individual pads, and also to maintain proper integrity of the liquid supply and withdrawal systems, there are transverse seals between the pads and at the ends of the set of pads. A suitable arrangement, for example, comprises an upright metal strip or thin plate 152 (FIGS. 5 - 6) extending across the machine, transversely of the belt path and between slots 154 (in which the ends of this strip are received) in the side plates 82. Each of these rigid strips is coated or encased with rubber 156 and carries an upper fin 158 likewise of rubber along its length except near slots 154. This resilient or elastic structure thus in effect constitutes a partition entirely across the belt carriage between successive cooling pads 80 and at the initial and final transverse boundaries of the first and last pads. The upper rubber portions 158 of these members conveniently bear against the under surfaces of the heads 104 of the guide elements 102 immediately adjacent this sealing partition, as shown in FIGS. 6 and 7. That is to say, the guide element heads of the respectively adjacent pads project alternately over the sealing strip, in the partial interlocking configuration that characterizes all the adjacent staggered pairs of rows. In this manner the sealing strip constitutes an effective seal along the cooling elements 102 all the way across the belt carriage, except for the narrow space occupied by the cooling layer of water wherein the pattern of flows in effect precludes the need for a seal.

For side seal of the belts, the frame members 82 carry a large compressible sealing ring 160, e.g. a hollow rubber tube or the like, completely around each belt carriage on the horizontal edges of the plate structure 82 at each side, this sealing and supporting member 160 being held in a groove 162. Further side seal can be provided at the localities of the cooling pads, e.g. inward of the outer seal ring 160 toward the casting space, for best retaining the water in the cooling regions and preventing either escape of water or inlet of air. For example, as seen in FIGS. 5 and 6, an elongated tubular rubber sealing element 164, advantageously larger than the element 160, is carried between the inner face of the side plate 82 and a metal strip 166 which in effect is constituted as an upright flange, sloped slightly over the rubber element 164, of a length of metal angle 168 that has suitable holes through which it is held by the bolts 148. The sealing element 164 is thus held in the groove formed by the flange 166, plate 82, and a horizontal step 169 of the pad plate 84, one such element extending along each side of the pads 80, passing cut-out regions of the seals 158. As will be understood, other longitudinal seals can be used, e.g. of rectangular section, with a low-friction face backed by foam rubber.

The end bearing structues 32, whereby each associated belt approaches the casting cavity around a semicylindrical or other curve, preferably carry each belt on a liquid layer bearing. Advantageously a lower portion of this structure for the upper carriage, and the upper portion of the structure for the lower carriage, can be arranged to provide the same cooling operation as the elements 102 in the cooling pads along the mold cavity 22. Thus the bearing structure 32 includes a curved plate portion 170 (this being specifically described for the upper one of the structures, with which the one below is identical) that extends from the locality 24 where the path of the belt departs into the mold cavity on a tangent plane, rearwardly up the curve for a considerable distance, e.g. angularly defined as more than 10° and advantageously a distance in the range of 30° to approximately 45° as shown. Throughout this part of the belt path (see FIGS. 2 and 4), the underlying surface is constituted by a large multiplicity of guide-faced cooling elements 172 arranged with their faces in partially interlocking rows exactly like the rows of elements 102, and each likewise having a slightly concave circular face 173 in its head 174, with a central jet aperture 176 through which liquid is directed at high pressure from the underlying chamber 178.

Hence the entire underlying support for each belt, through this region, is constituted in effect by means similar to the cooling pads, whereby the highly efficient, rapidly flowing liquid layer, i.e. flowing in a radially outward direction from each of the individual jets, is produced, and the belt is supported and guided or stabilized by these nozzle faces 173, with an intervening bearing layer of liquid. This liquid, e.g. water, then passing down into the space below the heads 174 of the elements, is withdrawn in any suitable manner, as through an array of many slots 180 across the assembly in that edge of the plate 170 which adjoins the transverse sealing element 158 (which seals the sides of the slots) at the entering boundary of the first cooling pad 80. The slots thus open to the space under all the element heads 174 and register with slot passages 182 (in a frame wall 183), that extend through coacting passage structure 184 into an outer chamber 186 contained in a head portion 188 of the main carriage frame that is surrouned by an offset cross-wall assembly 190 of the bearing structure 32.

By this arrangement, each of the curved bearing supports 32 includes a portion where the belts are guided and cooled in the same way as by the cooling pads. Special yieldability (although possible) is ordinarily not needed in this region of the belt path, and therefore the elements can be rigidly mounted in the plate 170. Water under pressure is supplied to the chamber 178, from which it flows through the axial recesses 192 in the elements 172, to provide the jets through the openings 176 against the reverse surface of the belt. The faces 173 of the heads 174 of the elements 172 are preferably ground to conform to the cylindrical curvature of the complete bearing structure 32, for collectively defining the curved path for the belt. Each face 173 has a central, shallow concavity shown as conical (FIG. 4), but it may advantageously be fashioned by grinding a very shallow indentation of cylindrical shape crossing the element face along a line in the direction of belt travel, forming a concavity in the cylindrical face.

The remainder of each belt bearing 32, such as the upper one in FIGS. 1 and 2, is constructed to carry the belt 20 on a water layer, by distributing water through a cylindrically-curved plate portion 194 from an interior chamber 196. As an example of a suitable liquid-layer bearing, or so-called foil bearing, the present structure (see FIGS. 2 and 3) has a large multiplicity of passages 198 (many transverse rows of many passages each) through the plate, opening from the chamber 196 via narrow apertures 200, whereby water under pressure in the chamber 196 is uniformly distributed through the passages in sufficient volume for the liquid bearing function over the surface of the curved plate 194, without the rapid flow desired elsewhere for cooling. In furtherance of uniform distribution of the water in the bearing layer, each passage preferably opens through a slightly concave face portion 202 of any suitable shape.

Water is removed from the surface layer around the plate 194 (and also additionally from the region between the nozzle heads 174 and the plate 170) by circumferential grooves 204 near the edges of the plates 194 and 170 disposed inwardly alongside of the side seal means (described below), and extending completely along the semicylindrical contour of the entire structure 32, up to the mold entrance 24 where each groove is substantially blocked by the transverse seal 158. The bottom of each groove 204 communicates (for withdrawal of water) through passages 205 into a corresponding drain chamber 206 in side structure 207 of the bearing assembly 32, which chamber in turn communicates (by suitable means not shown) with the outlet chamber 186. The plate 194 can conveniently be integral with the plate 170 that carries the cooling elements 172, and as shown each groove or channel 204 extends along the plate section 170, so that it serves to carry the discharge flow of water from the surface of the plate 194 and part of that from the region of plate 170 under the cooling heads 174. All of the discharge flow in the channels 204, either through the passages 205 and the chambers 206 or at the vicinity of the slots 180, eventually joins the further flow from the cooling section in the chamber 186 for ultimate withdrawal therefrom.

Inasmuch as the discharge pressure requirements for maintaining a liquid bearing layer around both the simple bearing and the cooling sections of the structure 32 can be the same, the described arrangement is suitable for removal of water maintained around the entire structure 32. As will be understood, the control of pressure and volume of water supply and withdrawal is such that proper delivery of water under pressure is effected through the openings 200 and the jet apertures 176 and the desired layer of water is maintained throughout the reverse face of the belt with intended characteristics at the several localities, with effective drainage of water from all areas. The conditions governing the state of filling or partial filling of the chambers 178, 196 and 186, and all related passages, are essentially the same as for the corresponding chambers and passages for the cooling pads, as for example in that air leaking into the grooves 204, which are maintained under slight subatmospheric pressure, can reach the chamber 186 and can be similarly managed. For holding each belt throughout its entire path over the plate 194 and the elements 172, its tensioned state in most cases obviates need for subatmospheric pressure at the belt face, e.g. to pull it toward the elements 172, although some such may be provided if desired for optimum removal of water or for other reasons.

As explained above, and shown in FIGS. 3, 8, and 7, the outermost rubber sealing and supporting elements 160 continue around the portions of the side plate structure 82 of the bearing assemblies 32. The latter also include sealing elements, e.g. larger rubber tubes 208 carried in circumferential grooves 209 spaced inwardly of the outer elements 160 (between the latter and the groove 204), and exactly corresponding in location and function to the elements 164 adjacent the cooling pads 80. Thus these further elements 208 can be deemed continuations of the seals 164 and afford primary means for preventing lateral fluid communication between the liquid bearing layer and the surroundings, throughout the length of the belt around the structure 32.

Although a transverse seal can be used between the cooling and simple bearing sections, this locality is traversed crosswise by a special distribution strip 210 (FIG. 2) which at its underside has a groove 212 receiving water under pressure through a transverse array of passages 214 from the chamber 196, and which through a multiplicity of very narrow passages (not shown) carries high velocity water to the end of the bearing layer on the plate 194, for reaction against voluminous flow of water in either direction circumferentially of the structure 32. An identical strip 210, mounted in the plate 194 across its end region 216, where the belt 20 commences its curved path, opposite to the locality 24, injects like, fine, high velocity streams into the bearing water layer, for like barrier effect. The foregoing instrumentalities are identically provided for the lower bearing structure 32 that serves the belt 21, and indeed the latter structure can be in all respects the same as the upper one, in inverted position. Alternative or further seals can be provided, if desired, for the bearing structures 32, for instance across the locality 216, where the side seals 208 terminate.

For simple illustration, FIGS. 14 and 15 (taken with other views) show purely schematically a water supply and circulation system for the apparatus (exemplified relative to the upper belt carriage), it being understood that actual details of such system in themselves form no part of the present invention and can embody any selection of components of known design suitable for the desired control and distribution functions. Here for example, water can be considered to be supplied at high pressure by a pump 220 in a main conduit 222 from which branch pipes 224, 226, 228 and 230 lead respectively to the chambers 196 (for the primary curved bearing section), 178 (for the curved belt cooling section ahead of the casting space), 136 and 138 (each serving two of the four cooling pads 80), these branch pipes including, if needed, corresponding regulating valves 234, 236, 238 and 240, i.e. to the extent that specific individual pressures are required at the downstream side of each line. Water discharge is provided through the pipes 242, 244, 246, 248 and 250 respectively from the exhaust chamber 186 for the entire curved bearing structure 32, and four separate exhaust chambers 98 for the four cooling pads 80. These discharge pipes may include separate, corresponding valves 252, 254, 256, 258 and 260, to the extent desired or necessary, to regulate the flows for separate, selected pressures upstream of the valves, i.e. in the several exhaust chambers, and the discharge pipes may all lead to a common discharge conduit 262, shown as including a further pump or other flow-regulating means 264. A like system of supply and discharge pipes can be provided for the lower belt carriage, connected with the same supply and discharge conduits or with separate such elements if desired.

As indicated in FIGS. 1 and 14, there can be (for each of the upper and lower belt systems) a further housing 266 adjacent to the last cooling pad 80 at the exit end 26 of the casting space, containing a single row of cooling nozzles across the belt path, identical with the elements 102 and having high pressure water supply and water withdrawal as indicated. The arrangement (not shown) of these elements is with their heads overlapping the last transverse seal 158, to complete the sealed situation of the last pad 80.

It may be explained that where necessary the side plate structures 82 of the belt carriages are sectionalized, for example in that the side plate portions 270 adjacent each drive roll 28 should usually be separate elements aligned with the main side plate sections but mounted and arranged to move with the roll journals such as 52, 60, when the latter are displaced to slacken or tension the belts. The outer seal element 160, passing around the entire belt path, can be sufficiently elastic to accommodate the normal range of adjustment of the plate parts 270. Indeed, the various sections of each carriage housing structure, including the side plate sections, can be arranged in a mutually interfitting, sliding member so that each carriage housing, so completed by its belt traveling on the seals 160, is in effect a sealed enclosure.

In accordance with the present invention, and employing structures with appropriate sealing means as exemplified in the drawings, the coolant supply is preferably arranged as a closed, recirculating system, e.g. with appropriate means for such purpose connecting the discharge conduit 262 to the supply conduit 222. For example as seen in FIG. 15, such means may include a closed pit or reservoir 272 which receives water from the conduit 262 and from which the pump 220 or other means draws water for the supply conduit 222 through a heat exchange and temperature control unit 274 and a treatment unit 276. These elements, embodying known principles, are shown schematically and for simplicity as connected in a system separate for each belt assembly, but it will be understood that they, and likewise the supply and discharge pipes 222, 262 may if desired serve the cooling means of both belt carriages. The reservoir 272 may be a closed pit beneath the machine or a vessel or vessels alongside one or both of the carriages, or may be a combination of such means. The unit 274 may provide heat exchange with external cooling fluid of any suitable kind, such means being schematically shown at 278, and may include temperature-sensitive means controlling the exchanges 278 so as to maintain a desired temperature, or range of same, in the water flowing to the conduit 222 for belt cooling.

A particularly advantageous process, which further keeping the entire circulation of water to, through and from the belt cooling means in fully enclosed condition, involves keeping the water supplied to the belts at an elevated temperature, specifically for example in the range of 40° to 70° C, in contrast with prior belt casters where the water has been used at lower temperatures, indeed at or below ordinary atmospheric temperatures of 20° to 30° C. Heretofore, because of the mechanical complexity of trying to enclose prior cooling systems, open water flows have often been used, causing a special need for low temperature because at higher temperatures water has a much higher vapor pressure and produces much atmospheric vapor around the machine and consequent water condensation on the faces of the belts that travel into contact with the molten metal. Droplets of water on the belts have the undesirable effect of there generating vapor by the heat of the metal.

It has now been found that at the higher temperatures of the present process (e.g. 60° - 65° C), the heat transfer coefficient between the cooling water (e.g. in high velocity cooling layers 0.002 inch thick) and the belt is substantially higher, as of the order of 50%, with correspondingly greater efficiency of cooling. This is believed due to the decreased viscosity of the water, and the result is a greater heat extraction coefficient leading to a lesser tendency to distortion of the belt. At the same time, by reason of the enclosure of the system, there is no vapor trouble caused by the inherently higher vapor pressure of the water, and the tendency of ordinary atmospheric humidity to create condensation on the belts is reduced or avoided, inasmuch as the temperature of the belts is above, or substantially further above the dew point.

In carrying out the above cooling process, the water can economically be treated in any desired manner, as to avoid corrosion of the steel cooling passages and structures, and especially to prevent build-up of incrustations and solid sludge deposits when using hard natural waters. Such treatment may include de-ionization, addition of inhibiting agents and the like. For example, the treatment indicated at 276 may be a chemical control and feeder device, serving to maintain a suitable content of an inhibitor in the water, such as sodium chromate at a concentration, for example, of 500 p.p.m. It appears, moveover, that any tendency of the dissolved inhibitor to reduce the heat transfer coefficient is more than compensated by the effect of using water at elevated temperature.

Figure 8:
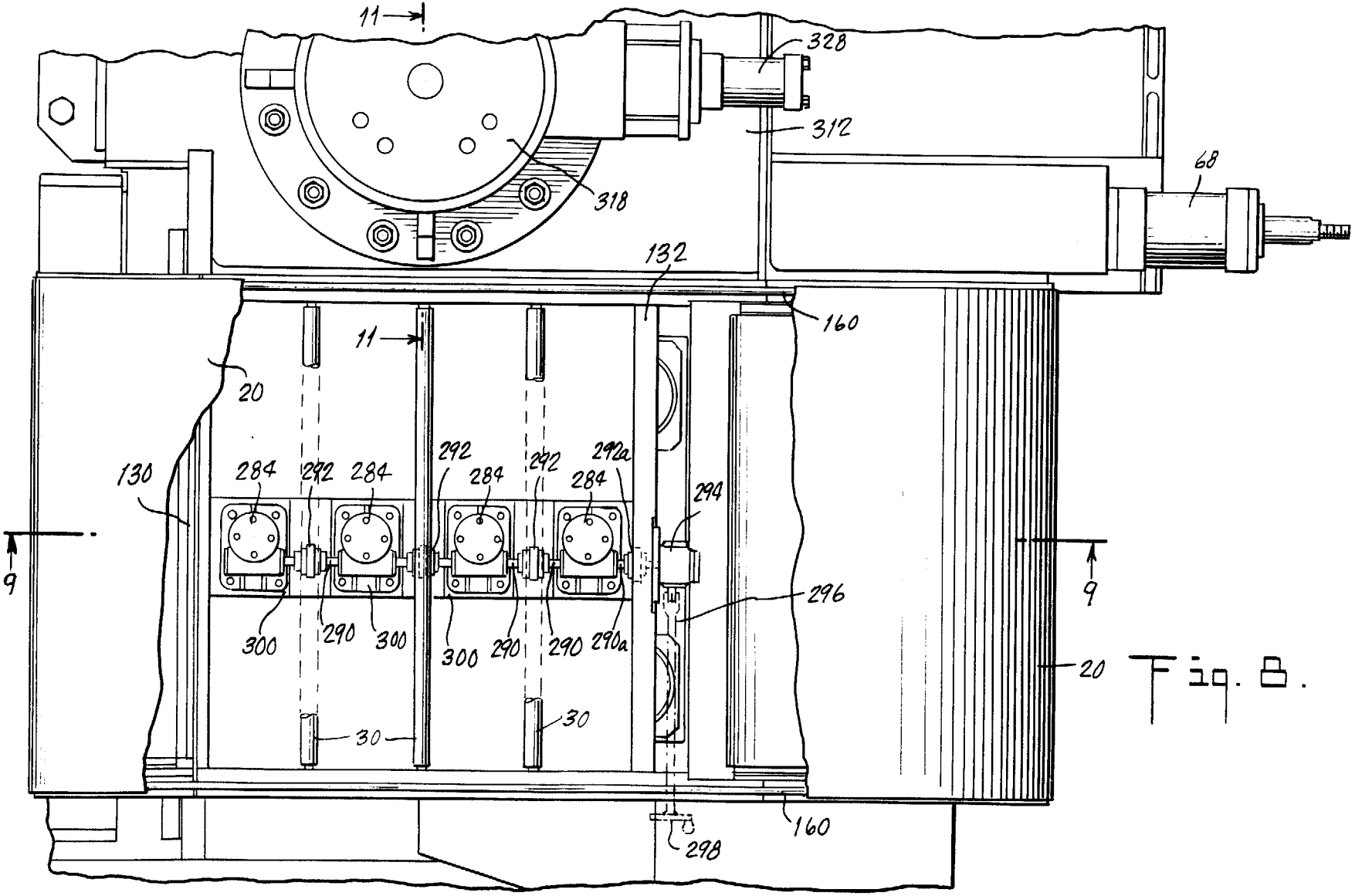
FIG. 8 is a top plane view of a main portion of the apparatus, with portions of some elements, including the upper belt, cut away.
Figure 9:
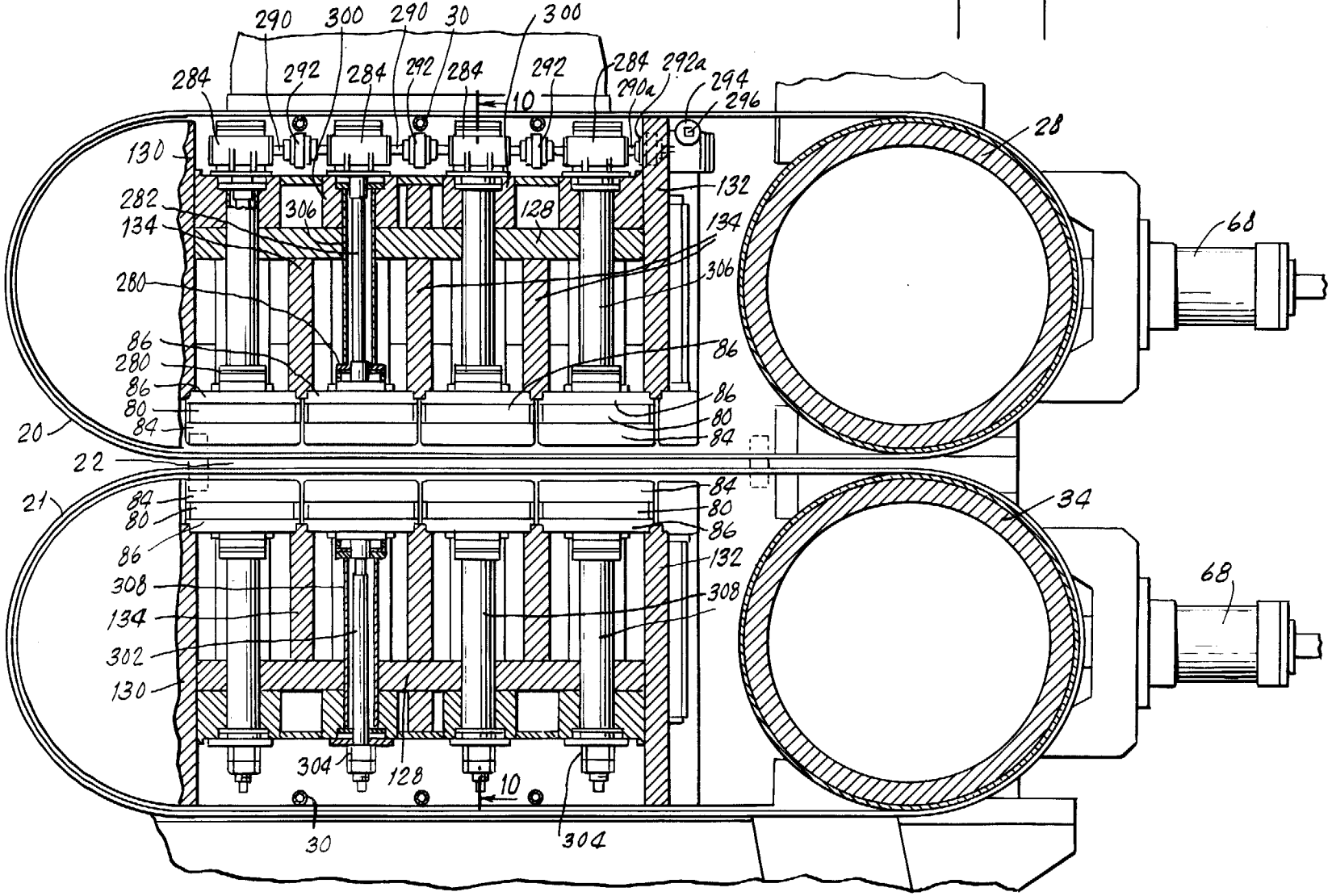
FIG. 9 is a vertical section on line 9—9 of FIG. 8.
Figure 10:
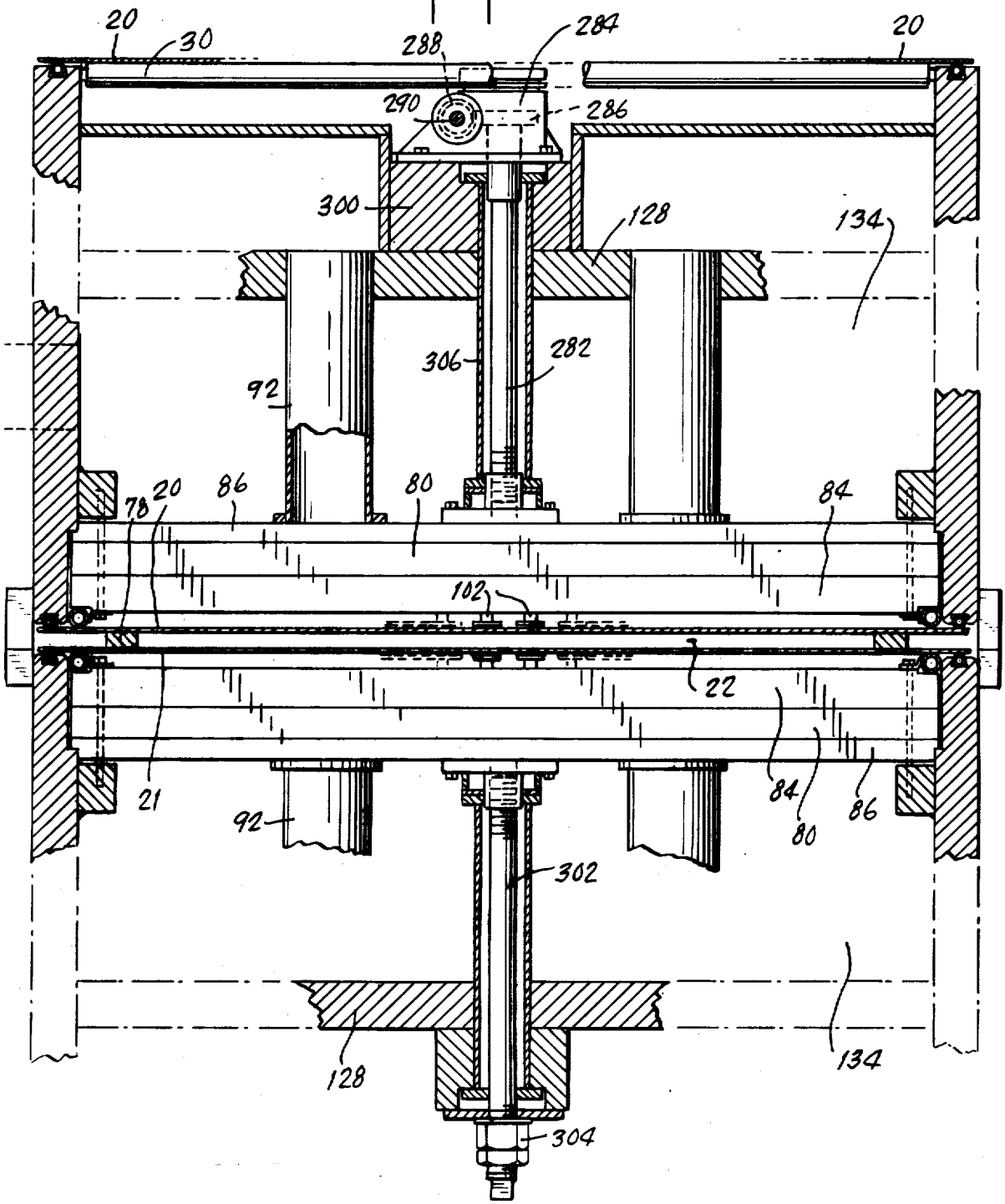
FIG. 10 is an enlarged, fragmentary, vertical section on line 10—10 of FIG. 9.

FIGS. 8, 9 and 10 illustrate, by way of example, an embodiment of suitable means for adjusting the contour of the mold space 22 across the path of metal, specifically by altering the shape of the supporting means for one of the belts, e.g. the upper belt 20, so that as held against the guiding elements, the belt may have a selected transverse profile, e.g. from plane through a range of concavity, facing the mold space. To this end, the upper cross-plate 86 of each upper cooling and supporting pad 80 carries, at its center, a rigidly affixed, female threaded member or nut 280 which engages the lower, threaded end of a vertical shaft or rod 282 which at its upper end is to be turned by mechanism 284, thus constituting the assembly as a screw jack. Each mechanism 284, carried by the upper, transverse plate 128 of the belt carriage, may comprise a worm gear 286 mounted on the screw shaft 282 and rotatable by a worm 288, whereby on turning the shaft 290 of the worm, the worm gear mechanism may be caused to exert, by its mechanical advantage, a large upward force at the center of the pad 80, thus elastically bending the pad from, say, a normally plane transverse contour to a curved shape or contour, e.g. of generally parabolic shape, having any degree of small concavity toward the mold space 22.

Although circumstances may sometimes require such jack means for less than all of the pads 80, the present machine includes one for each pad as indicated by the corresponding mechanisms 284, and although each such mechanism may be arranged to be separately actuated, it is presently deemed desirable to connect them for drive together, whereby the transverse profile of all the pads may be adjusted simultaneously. Thus the worm shafts 290 are successively interconnected, along the array of pads by couplings 292 of any type which is appropriate for substantially coaxial shafts that cannot be perfectly aligned and which can be readily disengaged. For instance, each device 292 may be a gear coupling of conventional design (and therefore not detailed) which includes male gears on the two shafts engaged by female gears carried in and coupled by a sleeve which can be shifted axially to free one shaft entirely from the other. With such coupling devices the jack drive mechanisms 284 can be individually disconnected, permitting individual removal of each and all of the pads 80 from the system, by then rotating the worm 288 of the selected mechanism until the screw shaft 282 is disengaged from the nut 280 on the pad, whereby the pad can then be disconnected from the carriage, as for servicing or replacement.

As will be understood, the separability of the couplings 292 also permits individual settings of the jacks (even for different base or reference pad contours, although such may not ordinarily be necessary) as may be required by the setting of the pads to provide a tapering course for the belt 20 (not shown in FIG. 9), i.e. convergence of the belts toward the exit end 26 of the mold space 22. As presently contemplated, for instance, the jack for each pad can be set to be operable from an initial position of rectilinear (plane) contour of the pad across the belt. It will be understood that suitable, very slight flexibility can be achieved in each of the jack assemblies (e.g. by bending of the shafts 282 or accommodation in the jack gearing) so as to accommodate the slight tilt of the corresponding pad 80 in the direction of belt travel as may be required by the adjusted mounting of the pad to taper the belt path.

Although powered means can be employed, a useful manual drive for the jacks comprises a further worm gear mechanism 294, which is mounted at the end plate 132 of the belt carriage, and which has its worm gear connected through a gear coupling **292*a* to the last drive shaft 290*a* of the array of mechanisms 284, and has the drive shaft 296 of its worm extended through the side of the belt carriage. By a suitable hand wheel 298 mounted on the shaft 296, the latter may be turned manually, and through the further mechanical advantage of the mechanism 294, the drive shafting 290 of the train of mechanisms 284 may be turned, actuating all of the jacks at once and lifting the center regions of all the pads 80** simultaneously, e.g. to the same selected extent for all of them.

The belt carriage structure is very massive and rigid, particularly by virtue of the tall, heavy ribs or cross-plates 134 and end ribs or plates 130, 132 (between the side plates 82), together with the horizontal plate 128 to which the jack gear mechanisms 284 are mounted, i.e. upon the blocks 300. Each pad 80 is a separate box-like structure, into which its transverse plates 84, 86 are fully integrated as described and shown (e.g. FIGS. 5 to 7 showing chiefly the lower pads, the upper pads being identical) but the pad is preferably supported only at its side edges, i.e. being bolted to the side plates 82 of the belt carriage and secured upwardly (for the upper pads) against the belt-edge-adjacent regions 145 of the cross ribs, at its corners, with shims as needed. In consequence, by virtue of the jacking force which can be exerted between the massively rigid carriage structure and the intermediate locality of each pad 80 (transversely of the latter), i.e. downwardly from the plate 128 and upwardly of the pad, an elastic strain is applied to the pad, which is thus bent or deflected upward (in its entirety) at such locality, whereby it assumes a desired, slightly curved contour between its side edge regions. Correspondingly the guiding faces of the nozzle elements 102 are in effect caused to lie in a surface which from side to side of the belt path has a profile concave toward the belt and mold space and therefore the belt, held against the faces (through the coolant layer) as has been described, has a like concave chamber.

In this way, the mold space is contoured to the extent necessary to compensate for any otherwise undesired effect of the last-solidifying interior regions of the passing metal to be forced (as liquid) by reasons of overtapering, or other reasons, rearwardly of the direction of travel causing slight inward relative positioning of the surface shells along the center line. With the contouring adjustment, the surface shells start with a corresponding slight convexity, and the rearward flow then can result in their moving inward to a true planar shape. As will be understood, the mounting of the last pad or pads can be such, if necessary, that the solidification of the edge regions of the strip has caused the nozzle elements to be moved outwardly (of the mold space) against their yieldable supports before such effect occurs at the transverse center of the pad or pads. In this way, the entire effect (of the cambered pad and the yieldable elements) can be such that as the metal approaches full solidification, the actual collective position of the guide faces may assume a plane configuration, exactly as desired for the surface of the cast strip.

It will be understood that the displacement of the pad 80, e.g. as measured at its center locality and from its original rectilinear profile, is relatively small, and in no event need be so much that the faces of any two nozzle elements 102 adjacent in a crosswise direction are mutually displaced from a plane surface common to them by an amount affecting their mutual function of maintaining a proper, cooling and bearing layer of liquid, for example a layer having a thickness in the range indicated elsewhere herein. Although shimming of the pads 80 (e.g. for achieving a desired mold taper) as between the horizontal corners of their plates 86 and the horizontal edges of the carriage ribs or plates 134 (or corresponding end plates 130, 132), in the region indicated at 145 in FIG. 7 for the lower pads, may provide sufficient space between each pad and the stated transverse plates to permit the desired contouring adjustment, it will be understood that (if necessary, particularly where no shims are used) such edges of the plates can be relieved, i.e. cut away across the width of the carriage except for a short space adjacent to plates 82 at each side, enough to accommodate the needed range of contouring by bending the pad upwardly toward the vertical plates. Indeed it is only necessary that these plate edges have position-determined faces at the above spaces near the side plates, next to the pad corners, where shims may or may not be used; collectively, such spaces can provide a fixed, precise reference plane for all setting and adjustment of the pads.

An important feature of the structure shown is that the camber of the pads is adjustable while the machine is running. If at the outset the issuing cast strip is thin in the middle, the hand wheel can be turned to increase the upward curve of the pads; if the strip bulges at the middle, the camber can be backed off by turning the wheel the other way, the pads then returning elastically to less curvature. Attainment of a flat product can thus be a matter of simple, immediate adjustment.

Although similar contour adjustability can be provided for both belts, it is presently deemed sufficient to adjust only one, and indeed for many purposes it appears adequate to maintain a plane, non-tapering path for the other belt, e.g. the lower belt as shown. Thus the lower pads 80 are assembled at their transverse centers by verticl rods 302 serving as bolts, to the horizontal plate 128 of the lower belt carriage, being held against the horizontal edges of the carriage ribs. If instead of an exact planar configuration for the bottom pads it appears desirable to bias them to have a curved transverse contour in either direction, such can be done with shims between the corners of the pads and the bottom frame ribs 130–134, or altenatively by shimming the central portion of the horizontal edges of the carriage ribs before assembly of the pads 80 by the bolts 302 and 304. Conceivably such initial contouring of the lower pads might be desirable in some cases to allow adjustment of the upper screw jacks, during product runs, within an optimum operating range through which the top pads can be pulled up.

Sealing tubes 306 are provided around each of the screw shafts for the upper jacks with appropriate water seals at their ends so that the shafts and related parts can be isolated from the liquid in the surrounding space, especially to permit a lubricated environment for the screw. For similar protective function, like sealing tubes 308 can be provided for the lower, pad assembly rods 302.

FIGS. 11, 12 and 13 (see also FIGS. 1 and 8) show mechanism for separating the belt carriages, particularly for raising the upper carriage to a sufficiently elevated position to permit removal and replacement of belts 20, 21, removal and replacement of cooling pads 80, and all other necessary servicing and adjustment as to both carriages. The lower carriage, for belt 21, is rigidly carried (at one side) by a massive supporting structure 310 which is bolted to further frame and base structure (generally designated 44) that supports the entire machine. The upper carriage, for belt 20, is rigidly carried, at the same side, by a like, supporting structure 312. In practice, each of these structures 310, 312, may also be a drain water header, i.e. constituting or enclosing coolant water withdrawal means such as shown schematically in FIG. 15. For purposes considered here the lower structure 310 carries an upright cylindrical column 314 which projects in sliding relation upward through the upper structure 312 which at its lower part, at about the level of the mold space 22, carries a positioning collar 316 in precise sliding fit around the column 314. There are also other vertical sliding guide means, 317*a* and 317*b* in planes parallel to the section of FIG. 11, between the structures 310, 312 to prevent the upper belt carriage from swinging about the axis of the column 314.

The upper supporting structure also carries a structural cap 318, around the top of the column 314, with an expandible fluid cylinder assembly 320 extending down from the top of the cap to a base 322 carried inside the column, so that by fluid pressure in the cylinder, e.g. hydraulic pressure, the cylinder can in effect press down on the stationary column 314, elevating the cap 318 and with it the structure 312 and the top belt carriage supported thereby. when this upper assembly is raised to a desired height, for example where a hole 324 in the side of the cap 318 is above the top 326 of the column, a fluid, e.g. hydraulic, pressure cylinder 328 mounted at the side of the cap can be actuated to force a safety pin 330 through the hole 324 to a position over the column top 326, thus releasably locking the assembly, including the upper belt carriage, in place, against loss of pressure in either cylinder.

For guiding and stabilizing the upper assembly in its upward travel relative to the column 314, a guide roller 332, journalled for free rotation on a horizontal axis in a plane perpendicular to the axis of the column, has a concave toroidal surface of revolution congruent with the cylindrical surface of the column 314 and is mounted on the upper assembly to engage the cylinder surface in rolling contact, through an opening in the cap 318, as the assembly with the roller moves vertically.

The upper belt carriage, in its lowermost working position, seats directly on the lower carriage by spacer means respectively located on the side frame plates 82 of the carriages, e.g. at the corners of the space where the belts travel along together. Such means are here schematically illustrated as four spacer blocks 334 mounted on the plates 82 of the upper carriage at the corners of the mold path, resting on corresponding elements 336 similarly mounted on the lower carriage. The weight of the top carriage is thus supported with the carriages in precise desired alignment, e.g. preferably an accurate parallel condition between the carriage frames. If desired, however, the block can be mutually dimensioned, i.e. between those at the metal entrance and exit ends, to provide some general tapering, i.e. convergence, of the mold cavity instead of relying entirely on the separate positioning of the cooling pads 80 to effect such taper.

A useful arrangement of the elevating mechanism is to provide a slight normal clearance between the column 314 and the cap 318, especially its roller 332, so that when the upper carriage is seated by its blocks 334, in aligned position controlled by the collar 316, the roller 332 is slightly spaced from the column. The center of gravity of the upper assembly is located to the right of the column as seen in FIG. 11. When the assembly is started upward as powered by the cylinder 320, gravity causes the entire assembly, including structure 312, cap 318 and the top belt carriage, to rock very slightly to the right, i.e. clockwise about the collar bearing 316 (as seen in FIG. 11) so that the roller 332 comes into firm guiding contact with the column 314. This slightly drooped condition of the carriage then persists, without change, as the carriage is raised to and latched at its high position. To lower the carriage, the pin 330 is unlatched, and the cylinder 320 is controlled to allow the assembly to fall slowly. As the spacer blocks 334 come into engagement with the elements 336, the carriage is thereby seated firmly in desired position, centered by the collar 316, and the assembly again becomes erect with clearance between the roller 332 and the column 314. In this fashion, effective means are provided for raising and lowering the carriage, having unusual simplicity and ruggedness in that the principal load-carrying bearings for stabilizing the vertical displacement are the collar 316 and the single guide roller 332.

Particularly important features of the present invention involve the provision of the belt-supporting means in a plurality of successive sections along the metal path, as exemplified by the use of a series of three to six of the illustrated pads 80, whereby the nature of the belt support or control at each section is individually adjustable not only with respect to the position of the section for taper or non-taper, but also as to such matters as cooling function and especially the manner or force whereby the belt is urged against the support and as to the manner and extent whereby the support exhibits compliance in permitting, for instance, minor outward and inward displacement of the belt and in affording yieldability, e.g. for belt force overcoming a limit loading, particularly such compliance that is highly localized both crosswise and longitudinally of the belt path.

Although other useful procedures can be carried out employing the sectionalized supporting structures or the localized compliance, especially localized yieldability or all of same, a notably significant aspect of the invention is a process of casting involving the provision of successively different conditions for handling the metal along its path from entrance as liquid to discharge as cast strip, corresponding to different requirements understood to exist, in effect at corresponding zones in the progress of cooling and solidification. This procedure can be well effectuated by the sectionalized nature of the belt guiding or supporting means, individually adjusted or controlled to serve the needs of the several zones.

Thus it is conceived, for the presently preferred method, that in a first zone at the caster entry, the metal is essentially fluid and behaves as such even though it is solidifying (whether with coherence or not) next to the belts. Acting, in effect, as liquid, it can maintain contact with the belts by metallostatic pressure, which may nevertheless be insufficient to stabilize the belts against the path-defining supports. Accordingly the belt is held firmly against the supporting means (with only hard or relatively little compliance) e.g. through the bearing layer of coolant if used, by independent force, which may be achieved by provision of significantly subatmospheric pressure in the enclosed coolant space adjacent to the rear surface of the belt, for instance a pressure below atmospheric by about 2 to 5 p.s.i., conveniently about 4 p.s.i. The metal will start forming shells with surfaces determined by the belt paths.

In a second zone of the cavity, usually along the middle (considered lengthwise) of the distance between cavity ends, the metal may be deemed to have coherent shells next to the belts, i.e. shells which may nevertheless not be entirely self-supporting. The shells are separated by liquid metal and may themselves be all solid or partly liquid. The surface of the shell may be strong enough to separate locally from the belt at places where the belt is held too rigidly, or may here start to distort locally due to uneven thermal stresses, while still maintained in general contact with the belt because of underlying pressure of metal feeding into the central sump. As indicated, however, the limited thickness and strength of the shell are such that it can develop a local surface contour independent of that tending to be imposed by a rigidly defined belt path and the internal metal pressure. In this zone there can be provided local, significant or relatively soft compliance in the path-defining relation of the supports to the belt, allowing the belt to move locally to a small extent outwardly or inwardly of the mold space. For example, using the liquid coolant layer means, the latter may be operated in a relatively soft range, with relatively little (or perhaps no) independent force pulling the belt toward the supports, e.g. a low vacuum for the coolant space, as 1 p.s.i. or less below atmospheric. The belt can therefore act as an elastic support for the metal shell, keeping uniformity of contact and avoiding run-away thermal distortion of the shell.

In a third zone toward the cavity exit, the shells may be considered sufficiently interconnected so that the effect of metallostatic pressure disappears, but by the tapering of the cavity (to compensate or over-compensate for the usual metal shrinkage on cooling), the metal, in effect, forces itself against the belts so that the supports, with loaded, local yieldability, can continue to keep the belts in contact with the metal surface. Here, if the bearing layer of rapidly flowing coolant is employed, the same soft compliance can be retained as in the second zone for the same reasons if and while they may persist; as the metal becomes in effect a solid, it pushes the belts into the high stiffness range of the liquid layer, and then overcomes the loading force to move the supports outwardly, i.e. bringing into play a different and much extended order of compliance. The taper preferably can begin in the second zone, or conveniently from the entrance, without affecting shell-to-belt contact adversely and with the advantage of maintaining a proper shell surface (taking account of the preferred transverse convexity of the mold space) with respect to longitudinal flow of the internal fluid metal.

As will now be apparent, this procedure is readily performed with the described apparatus, as for instance by operating the first pad 80 in the series to serve the purposes of the first zone, the last pad 80 to suit the third zone requirements, and the intermediate pads 80 in accordance with the needs of the second zone, especially in that the operation in the third zone is also achieved (if the support elements themselves are individually yieldable) by the controlled setting for second zone conditions. As will be understood, these requirements may differ for different alloys, having different characteristics of solidification, and for different casting speeds, thicknesses of cast product, and the like, but such requirements are readily determinable, in any given use, by simple test or knowledge of the properties of the given metal.

To illustrate the positioning of the pads 80, as for example to provide a converging taper of the belt paths from entrance 24 to exit 26 of the mold space 22, FIG. 14 is a grossly exaggerated view of such taper as achieved with shims of appropriate thicknesses on the described mounting seats at the corners, for example, of the upper pads, e.g. beginning at the far corners of the first pad 80 in the direction of belt and metal travel. Normally the angle of such required taper (whether achieved by adjusted setting for one belt or for both) is so small as to be incapable of representation in a drawing on this scale, an example being a total dimensional decrease, between the metal surfaces, of 5% of the gauge of the product strip. Nevertheless, the machine is capable of being set, by the described positioning of the pads, to achieve any desired contour, whether tapering or otherwise, of the belt paths as found necessary to produce cast strip of selected thickness with plane, paralel surfaces; the range of longitudinal contouring necessary for this purpose is relatively small, but has not been heretofore attainable as readily as here. If the desired degree of taper differs along the path (including parallel belt surfaces if needed at one place or another), e.g. to account best for shrinkage of the metal during solidification as may vary with different alloys, the sectionalized arrangement of the pads permits this result. Furthermore, the yieldable limit-loaded situation of the support elements cooperates in allowing full extent of taper to compensate or preferably to over-compensate for metal shrinkage with the individual guiding elements then yielding, e.g. toward the end of the path, to deliver properly solidified strip of precise, uniform thickness.

In using the preferred liquid bearing layer of coolant rapidly flowing over mutually adjoining, localized areas collectively covering the reverse surface of the belt, such layer is preferably extremely thin, as for example in a range below 0.01 inch, e.g. between 0.001 and 0.005 inch measured between the belt and the flat peripheral region of each nozzle face 106, being a magnitude of such layer which is attainable with supply of coolant (e.g. water) to the interior 112 of each element to a suitable pressure, for instance in the range of 10 to 100 p.s.i. (pounds per square inch). As will be understood, the spacing shown in the drawings as corresponding to this layer is exaggerated for clarity, as is also the depth of the concavity in the nozzle faces, such as the face 106; for example, the angle of this cone to the base plane of the face need not ordinarily be more than a few degrees, e.g. about 1° to 3°. The foregoing values are given as examples presently deemed suitable, for instance in casting aluminum, but it will be understood that other thicknesses of water layers, e.g. larger but in most cases not more than a small fraction of an inch, and lower or even considerably higher supply pressure can be employed.

As may now be appreciated, one important function of the preferred, slight concavity in the nozzle face 106 is to prevent possible inadvertent sticking or sealing of the belt to the face, as may sometimes occur between prefectly smooth, plane surfaces. Other shapes of guiding face for the nozzle can be used, provided no sealing can occur. The function of the liquid layer produced by the cooling nozzles is both to support the belt and to cool it. To maximize the cooling effectiveness, the supporting (and cooling) fluid must move rapidly in the layer, and must not become too hot by remaining on the belt surface too long; hence the cooling pads have many feeding and withdrawal points, spaced only a short distance apart. Also, the stand-off between the belt and the nozzles is kept small to insure a high velocity of the fluid, for example water, for a relatively low volume of flow.

These nozzles permit the attainability of a selected repulsive force on the belt through a range down to zero and, if desired, down to a slight negative value, as through the above range of relatively low values of stand-off distance, while maintaining high heat transfer coefficients. There can be achievement of a high modulus (rate of increase of repulsive force per unit decrease of stand-off) at very small stand-off, leading, if desired, to belt path stability close to what could be achieved with a solid plate in supporting contact with the belt, yet retaining cooling of 100% of the belt surface by high velocity fluid; this can be the situation of stiff compliance desired for the first zone of the present process.

In practice, significant characteristics of the described liquid, cooling bearing are such that over a small distance of stand-off, as in the above examples, increase of belt-stand-off is accompanied by decrease of repulsive force to a negligible value or to a small negative value, and decreasing the stand-off through the range (belt brought closer to the nozzle) causes a rise in repulsive force, more steeply as the lower values are approached, so that the support becomes stiffer and stiffer until the force reaches a safe maximum level at which the limit load feature (of yieldability of the elements) becomes effective to limit (1) the further increase of the force, and more importantly, (2) the decrease of the coolant flow below a safe minimum value. At all operating distances, therefore, an adequate fluid flow is maintained for cooling. As will now be seen, the repulsive force effects changes in modulus, from a very low modulus (soft compliance) at larger stand-off, to high modulus (stiff compliance) at small stand-off, permitting ready selection to suit the conditions required for different zones of the preferred process of the invention.

The casting apparatus is preferably constructed and arranged so that the belts are forced outwardly toward the cooling pads to the extent necessary to keep them in their paths and to insure proper cooling. In some circumstances or parts of the casting space, such effect may be caused by gravity, e.g. on the lower belt, or in some regions sufficiently by head of the metal, or, for example near the end of the space, by the solidified shells or entire body of the metal. Most importantly (for example a desired for different zones), such force can be exerted at any locality by pressure difference between the faces of the belt, independently of the metal; thus if the coolant outlet pressure of a cooling pad is kept below atmospheric, for example by 1 to 5 p.s.i., the belt will be correspondingly forced toward the nozzles collectively.

For illustration, at a higher part of the pressure difference range, the belt may be forced closed to the nozzles, say for a stand-off of 0.002 inch or less, with corresponding stiff compliance in support of the belt (e.g., first zone); for a lower pressure difference, the stand-off may be, for example, 0.004 inch, with relatively soft compliance (e.g. further zones); if significantly high force is exerted from the belt (as by solid metal), the repulsive force across the liquid layer becomes very high and the nozzle yields against its loading, allowing the nozzles to move outwardly while still keeping a sufficient flow for cooling action. The relation of these conditions to their selection for various successive pads 80 will be readily apparent.

There is a necessary relation between the stiffness of each flexible belt (governed by thickness among belts of like composition such as a selected steel) and the spacing between adjacent supports, for example the nozzle elements (if used) considered as abutted by the belt through the liquid layer. A belt which is not stiff enough to bridge the spaces between adjacent supports without sagging to an extent impairing the desired contact with the metal at some stage in freezing is clearly too limp, and likewise a belt must not be so stiff that its own resistance to deflection defeats the function of compliance and resilient loading at the nozzle elements. Meeting these requirements is easily determinable for any selected belt composition; indeed, for example, steel belts presently conventional for twin belt casters are generally suitable for the machine here shown.

The operation of the apparatus will be readily apparent from all of the foregoing. Molten metal is supplied to the inlet launder 70 where it may be quieted as it feeds into the casting zone entrance 24. It enters there as a substantially parallel-faced liquid body (with any actual converging taper of the belts if and as desired), and in its carriage through the casting zone 22 to the exit becomes progressively solidified from its upper and lower faces inward, preferably as affected by the controlled conditions of the successive cooling and guiding pads 80, until it is delivered a continuous, solid, cast strip.

The extent of compliance of the belt guiding means, can be adjusted or preset as may be desired for a wide variety of casting conditions. Indeed the various degrees of compliance selected for the successive sections of the casting path, whether in accordance with the above-described process or otherwise, can be chosen to prevent local failures of cooling and incipient gaps between the belt and the metal. The belt can accommodate localized small variations in metal surface contour without beginning to bridge adjacent localities (with further, progressive, adverse effects) and is generally stabilized in its path, while remaining in good contact with the metal at all places.

In consequence of all these features, high quality cast strip is attainable with uniformity, at high speeds and for all gauges from very thin to thick, and with a wide variety of metal compositions, including alloys heretofore difficult or impossible to cast continuously. The invention fully achieves each and all of the objectives, advantges and new results hereinabove set forth or contemplated.

It is to be understood that the invention is not limited to the specific structures and procedures herein shown and decribed, but may be carried out in other ways without departing from its spirit. It is to be further understood that important aspects of procedure and apparatus herein disclosed are applicable to continuous casting of a variety of castable materials, including many different metals.

I claim:

1. An apparatus for the continuous casting of metal in strip form comprising a pair of movable heat-conducting belts defining therebetween a mold space extending over a predetermined distance from an extrance end of said mold space where liquid metal enters to an exit end where the metal traveling with the belts has become cast strip, means for guiding the belts along predetermined paths through said distance, said guiding means for at least one of the belts comprising at least several sections of guiding structure disposed in succession to each other along said distance and having belt-facing areas thereby collectively covering the reverse surface of said one belt adjacent to the mold space, at least a plurality of said sections having mounting means adjustably settable to locate the section individually over a range of positions toward and away from the guiding means for the other belt, said adjustably settable means comprising means separately settable at least for the two ends of each section in the direction of belt travel, whereby each of said plurality of sections can be set to guide the adjacent belt along a path of selected position, and of selected direction in a range from parallelism through various degrees of taper, relative to the other belt, each of said several sections consisting of belt cooling and supporting means for a predetermined area of said reverse surface of said one belt, including a multiplicity of guiding elements distributed over said area crosswise and lengthwise of the belt path and constituted in a multiplicity of crosswise rows each containing a multiplicity of said elements, said elements of each of said several sections being disposed to lie collectively in a predetermined surface facing said reverse belt surface, and said elements of at least the last one of said sections in the direction of belt travel having mounting means whereby each element is individually displaceable in a direction away from the mold space, said section being constructed and arranged so that each element is releasably held in position in said predetermined surface and said mounting means comprising means yieldable to permit displacement of each element individually away from the mold space in response to force exerted by the belt.

2. An apparatus for the continuous casting of metal in strip form comprising a pair of movable heat-conducting belts defining therebetween a mold space extending over a predetermined distance from an entrance end of said mold space where liquid metal enters to an exit end where the metal traveling with the belts has become cast strip, means for guiding the belts along predetermined paths through said distance, said guiding means for at least one of the belts comprising at least several sections of guiding structure disposed in succession to each other along said distance and having belt-facing areas thereby collectively covering the reverse surface of said one belt adjacent to the mold space, each of at least a plurality of said sections comprising a multiplicity of guiding elements which are distributed over the area of the section crosswise and lengthwise of the path of the adjacent belt and which collectively lie in a surface defining said belt path past the section, said apparatus being constructed and arranged so that said belt can be urged outwardly of the mold space into conformity with said surface defined by the elements, each of said plurality of sections comprising means providing individual compliance for each element of selected modulus, to accommodate slight positional variations of the belt inward and outward of the mold space at the locality of the element, each of said compliance-providing means for each section comprising means for adjusting said compliance in modulus for the elements of the section.

3. Apparatus as defined in claim 2, in which said compliance-providing means of each section comprises cooling means for the reverse surface of the belt facing said section, constructed and arranged to provide a layer of liquid coolant in rapid motion separating said reverse surface from the guiding elements, said cooling means comprising flow-guiding means for providing resistive compliance of said coolant layer against displacement of the belt toward the elements, which resistive compliance increases in modulus with closeness of the belt to each element, and said compliance-adjusting means comprising means for adjustbly controlling the pressure of said liquid layer for each section through a range extending down to a value reduced sufficiently below the pressure on the mold-facing surface of the belt as to draw the belt firmly toward the elements, whereby the compliance provided by said cooling layer for each element can be adjusted in modulus by adjustment of said reduced pressure so as to adjust its effect in drawing the belt toward the elements.

4. An apparatus as defined in claim 2, in which at least one of said plurality of sections comprises mounting means for displacement of each element individually, and loading means for each element yieldable to permit displacement of the element away from the mold space upon exertion of force by the belt upon the element greater than is accommodated by the aforesaid compliance for the element.

5. In apparatus for the continuous casting of metal in strip form comprising a pair of movable heat-conducting belts, defining therebetween a mold space, said apparatus including, at each of the opposite sides of said mold space, means for guiding the adjacent belt along a desired path and means for cooling the reverse face of said adjacent belt, the combination in said guiding means for at least one belt which comprises, distributively throughout a predetermined area of the path of said one belt, a multiplicity of guide elements arranged in a multiplicity of rows successive along the belt path, with a multiplicity of said elements across the path in each row, said elements collectively lying in a desired surface adjacent to the reverse face of said one belt for defining said path, said elements being individually yieldably loaded toward the mold space, for individual movement away from the mold space upon excess belt force outward of the mold space.

6. In the combination claimed in claim 5, stop means for preventing movement of each yieldably loaded element beyond a predetermined position toward the mold space.

7. In apparatus for the continuous casting of metal in strip form between a pair of movable heat-conducting cooled surfaces following desired paths so as to define therebetween a mold space wherein metal is cast, against the surfaces, to solidify into the form of strip moving with the surfaces, said apparatus including a movable, heat-conducting belt providing one of said surfaces facing the mold space, a guiding and supporting assembly comprising, in combination, a multiplicity of closely spaced belt guiding elements distributed over a predetermined area adjacent to the reverse face of the belt at the mold space and having belt-facing portions arranged to lie in a common surface for defining a path for the belt, there being at least transverse rows of said elements, with at least several elements in each row, along said area, said guiding and supporting assembly being constructed and arranged so that the belt can normally travel in substantial conformity with the surface defined by said belt-facing portions, said elements being constructed and arranged so that each of the belt-facing portions is movable individually toward and away from the mold space, said construction and arrangement of the elements including means yieldably loading the belt-facing portion of each element individually toward the mold space, whereby each belt-facing portion can be individually moved outwardly of the mold space by excess belt force at the locality of the belt-facing portion.

8. In apparatus for the continuous casting of metal in strip form between a pair of movable heat-conducting cooled surfaces following desired paths so as to define therebetween a mold space wherein metal is cast, against the surfaces, to solidify into the form of strip moving with the surfaces, the combination comprising a movable, heat-conducting belt providing one of said surfaces facing the mold space, a multiplicty of closely spaced belt guiding elements distributed over a predetermined area adjacent to the reverse face of the belt at the mold space and having belt-facing portions arranged to lie in a common surface for defining a path for the belt, there being at least several transverse rows of said elements, with at least several elements in each row, along said area, said apparatus being constructed and arranged so that the belt can be forced outwardly of the mold space to hold it in a desired path conforming with the surface defined by said belt-facing portions, means for mounting each of the elements to be movable individually toward and away from the mold space, including stop means preventing movement of each element beyond a predetermined position toward the mold space, and means loading each element individually toward the mold space against the stop means, said loading means being yieldable so that each element can be individually moved away from the stop means by excess belt force outwardly of the mold space, and means for applying coolant to said reverse face of the belt, for providing a layer of coolant between said reverse face and said elements.

9. In a method of continuous casting of metal in strip form between movable heat-conducting belts defining therebetween a mold space along which the belts travel, while metal is introduced as liquid at one end of said space and discharged as cast strip at the other, exit end, and while cooling the belts by flow of liquid coolant on their reverse surfaces, the procedure of guiding the belts along said space comprising providing at the reverse surface of at least one belt a multiplicity of supports which are distributed over an area to be guided and which collectively define a surface along which the belt can travel, said supports being arranged in a multiplicity of rows successive along the course of belt travel with a multiplicity of said supports crosswise of said course in each row, causing the belt to travel in a path normally stabilized to conform substantially with said defined surface, and causing each one of said supports to yield, individually, outwardly of the mold space upon exertion by the belt of excess force toward and against said support at the locality of the support.

10. In a method of continuous casting of metal in strip form between movable heat-conducting belts defining therebetween a mold space along which the belts travel, while metal is introduced as liquid at one end of said space and discharged as cast strip at the other, exit end, and while cooling the belts by flow of liquid coolant on their reverse surfaces, the procedure of guiding the belts along said space comprising providing at the reverse surface of at least one belt a multiplicity of supports which are distributed over an area to be guided, and have guiding faces collectively lying in a surface to define a path for the belt, said supports being arranged in a multiplicity of rows successive along the course of belt travel with a multiplicity of said supports crosswise of said course in each row, maintaining said liquid coolant in a layer between the belt and the guiding faces while causing the belt to exert force through said layer toward the guiding faces for holding the belt in a path stabilized to conform with said path-defining surface, and causing each one of said supports to yield, individually, outwardly of the mold space upon exertion by the belt of a force toward and against said support, greater than a predetermined value of force which is sufficient for holding the belt stabilized as aforesaid.

11. A method of continuous casting of metal in strip form between heat-conducting belts defining therebetween a mold space over a predetermined distance while metal is introduced as liquid at an entrance end of said distance and discharged as cast strip at the other, exit end of said distance and while cooling the reverse surfaces of the belts and providing a multiplicity of supports for each belt distributed throughout said distance and arranged to define a path for the belt, the procedure comprising, for at least one of the belts:

a. cooling the belt by maintaining a thin layer of rapidly flowing liquid coolant over the reverse surface of the belt as a bearing layer between said reverse surface and said supports;

b. exerting force on said one belt independent of metal in the mold space to urge the belt firmly against the bearing layer and through it against the supports, along a first zone extending from the entrance to not further than an intermediate point of said distance, being a zone where the metal is still essentially fluid;

c. exerting little or no force independent of metal in the mold space on the belt toward the supports, through a second zone of said distance, where there are coherent shells of solidified metal adjacent to the belts, extending from the first zone toward the exit at least to a point where the metal behaves essentially as a solid, so that the bearing layer of flowing liquid coolant affords soft compliance, by compression of said layer between the belt and the supports; and d. yieldably loading each support individually toward the mold space, while controlling said loading for yield of each support locally upon exertion of outward force by the belt substantially greater than the outward force on the belt at the first zone, through a third zone of said distance, including a terminal zone where the metal behaves essentially as a solid, extending to the exit from said second zone or from an earlier point in said distance.

12. A method as defined in claim 11, which includes providing said supports for said belts in closely spaced relation disposed in a multiplicity of successive rows along the paths of the belts, with a multiplicity of said supports in each row.

13. A method as defined in claim 11, which includes disposing said supports to define the paths for said belts so that there is convergence of the belt paths at least toward the end of said distance, including controlling the extent and contour of said convergence along the mold space for compensation or over-compensation of the belt paths for the volume shrinkage of the metal as it solidifies.

14. A method as defined in claim 11, in which the aforesaid defined steps relative to said one belt are also performed relative to the other belt.

15. A method as defined in claim 11, in which the step of exerting force on the belt in the first zone is effected by maintaining, in the liquid coolant at the reverse surface of the belt, a pressure which departs below atmospheric sufficiently to exert said force by suction on the belt.

* * * * *

UNITED STATES PATENT AND TRADEMARK OFFICE

CERTIFICATE OF CORRECTION

PATENT NO. : 4,061,177

DATED : December 6, 1977

INVENTOR(S) : OLIVO GIUSEPPE SIVILOTTI

It is certified that error appears in the above-identified patent and that said Letters Patent are hereby corrected as shown below:

Column 1, line 57, "or" should read -- of --.

Column 4, line 51, "yeild" should read -- yield --.

Column 4, line 63, "solification" should read -- solidification --.

Column 6, line 61, "of" should read -- on --.

Column 8, line 16, "belt" should read -- belts --.

Column 12, line 1, "removable" should read -- removably --.

Column 12, line 52, between "will" and "be" insert -- now --.

Column 13, line 14, "flame" should read -- frame --.

Column 16, line 25, "outer" should read -- outlet --.

Column 16, line 27, "surrouned" should read -- surrounded --.

Column 18, line 41, between "for" and "separate" insert -- maintaining --.

Column 19, line 34, "further" should read -- includes --.

Column 21, line 57, "chamber" should read -- camber --.

.....

UNITED STATES PATENT AND TRADEMARK OFFICE

CERTIFICATE OF CORRECTION

PATENT NO. : 4,061,177

DATED : December 6, 1977

INVENTOR(S) : OLIVO GIUSEPPE SIVILOTTI

It is certified that error appears in the above-identified patent and that said Letters Patent are hereby corrected as shown below:

Column 28, line 1, "a" should read -- as --.

Column 31, line 11 (Claim 7), between "least" and "transverse" insert -- several --.

Signed and Sealed this

Second Day of May 1978

[SEAL]

Attest:

RUTH C. MASON
Attesting Officer

LUTRELLE F. PARKER
Acting Commissioner of Patents and Trademarks